US007182061B2

(12) United States Patent
Georgescu

(10) Patent No.: US 7,182,061 B2
(45) Date of Patent: Feb. 27, 2007

(54) ROTARY INTERNAL COMBUSTION ENGINE

(76) Inventor: Petrica Lucian Georgescu, 1717 N. Bayshore Dr., #3115, Miami, FL (US) 33132

( * ) Notice: Subject to any disclaimer, the term of this patent is extended or adjusted under 35 U.S.C. 154(b) by 0 days.

(21) Appl. No.: 11/027,698

(22) Filed: Dec. 30, 2004

(65) Prior Publication Data

US 2006/0070602 A1 Apr. 6, 2006

(30) Foreign Application Priority Data

Oct. 4, 2004 (RO) ..... A/00835

(51) Int. Cl.

| | |
|---|---|
| ***F02B 53/00*** | (2006.01) |
| ***F01C 1/00*** | (2006.01) |
| ***F04C 18/00*** | (2006.01) |
| ***F04C 2/00*** | (2006.01) |

(52) U.S. Cl. ..... 123/245; 123/241; 418/34; 418/37; 418/38

(58) Field of Classification Search ..... 123/245, 123/241; 418/35–38

See application file for complete search history.

(56) References Cited

U.S. PATENT DOCUMENTS

| | | | | | |
|---|---|---|---|---|---|
| 2,155,249 | A * | 4/1939 | Bancroft | 418/37 |
| 3,087,671 | A * | 4/1963 | Myles | 418/34 |
| 3,505,981 | A * | 4/1970 | Turnbull | 418/38 |
| 3,645,239 | A * | 2/1972 | Cena | 123/245 |
| 3,899,269 | A * | 8/1975 | Diamond | 418/35 |
| 3,922,118 | A * | 11/1975 | Bancroft | 123/245 |
| 3,990,405 | A * | 11/1976 | Kecik | 123/245 |
| 4,026,249 | A * | 5/1977 | Larrea | 123/245 |
| 5,501,070 | A * | 3/1996 | Lin | 418/34 |
| 6,119,649 | A * | 9/2000 | Raab | 123/233 |
| 6,341,590 | B1 * | 1/2002 | Barrera et al. | 123/245 |
| 6,668,787 | B2 * | 12/2003 | Masters | 123/245 |
| 6,739,307 | B2 * | 5/2004 | Morgado | 123/245 |
| 6,880,494 | B2 * | 4/2005 | Hoose | 123/245 |
| 2005/0217636 | A1 * | 10/2005 | Turner | 123/245 |

FOREIGN PATENT DOCUMENTS

JP 06002559 A * 1/1994

* cited by examiner

*Primary Examiner*—Thai-Ba Trieu
(74) *Attorney, Agent, or Firm*—Malloy & Malloy, P.A.

(57) ABSTRACT

A rotary internal combustion engine comprising at least one but preferably a plurality of two operating chambers each having a toroidal path of travel on an interior thereof and an interactive piston assembly comprising a pair of first or driven pistons connected to a power take-off and a pair of second or driving pistons concurrently movable along the toroidal path of travel relative to said pair of first pistons. In each chamber, the pair of second pistons is periodically positionable, during each revolution, in driving relation to the pair of first pistons and is cooperatively structured therewith to accomplish the various phases of an engine cycle during forced travel of the pair of first pistons along the toroidal path of travel, thereby causing forced rotation or driving of the power take-off.

32 Claims, 32 Drawing Sheets

ROTARY INTERNAL COMBUSTION ENGINE

CLAIM OF PRIORITY

A claim of priority pursuant to 35 U.S.C. Section 119 is hereby made to an application for an industrial design filed by myself in Romania, namely, that having Ser. No. A/00835 and filed on 4 Oct. 2004, which application is currently pending.

BACKGROUND OF THE INVENTION

1. Field of the Invention

This invention relates to a rotary internal combustion engine having at least one but preferably a plurality of two operating chambers, each comprising an interior toroidal path of travel along which an interactive piston assembly travels. Each interactive piston assembly comprises a pair of first pistons and a pair of second pistons concurrently movable along the corresponding toroidal path of travel, wherein the pair of first pistons is connected in driving relation to a power take-off. The pair of second pistons is periodically positionable in driving relation to the first pair of pistons along the corresponding toroidal path of travel resulting in a driving, forced travel of the pair of first pistons and driving rotation of the power take-off.

2. Description of the Related Art

Rotary internal combustion (I.C.) engines have been known and utilized commercially for many years. One typical application of the rotary I.C. engine is the powering of automobiles and other motorized vehicles. Perhaps the best known and most extensively developed rotary engine is the Wankel engine. The Wankel engine, as well as numerous other rotary engines, despite years of attempted refinement and improvement, suffer from common and well recognized problems rendering rotary engines generally inefficient and accordingly undesirable from a commercial and/or practical standpoint.

More specifically, problems and disadvantages associated with rotary engines include a combustion/expansion chamber structured to include a cross-sectional area which broadens as the power stroke of the rotary piston advances. This in turn allows gases to expand radially into a space where they do not effectively accomplish mechanical work. In addition, many, if not most of the known or conventionally designed rotary engines require pre-compressed fuel resulting in accompanying losses of energy, especially through the loss of heat. Attempts to overcome problems of the type set forth above have resulted in sophisticated and somewhat complicated sealing assemblies cooperatively structured with a rotating piston to overcome significant combustion pressures in order to maintain adequate sealing contact with the internal surfaces of the rotary cylinder. However, to date it is questionable whether any known sealing assembly specifically designed and structured for operation in a rotary engine accomplishes satisfactory sealing to the point where known and recognized inefficiencies of rotary engines are overcome.

By way of example, the Wankel engine compresses its own fuel and suffers from inadequate sealing, short operative life of the seals, the existence of friction between the seals and the cylinder and between the rotor and end walls. In addition to such disadvantages, the Wankel engine, as well as attempted modifications thereof, encounters problems associated with loss of energy due to radial broadening of the expansion chamber. This is believed to be due, at least in part, to the shape of the Wankel expansion chamber in relation to its combustion chamber and to the rotary, triangularly configured piston that is characteristic of the Wankel engine.

Therefore, there is a long standing and well recognized need for the development of a rotary type internal combustion engine which overcomes the existing disadvantages and problems generally associated with known or conventional rotary engines. In addition, any proposed rotary I.C. engine, once developed, should preferably incorporate unique design features allowing for the elimination or significant reduction of the complex sealing assemblies, as well as a variety of other structural components normally associated with rotary I.C. engines. Elimination of such working components may best facilitate the ability of the resulting rotary engine to favorably compete with the prolific use of the reciprocating piston I.C. engine. Such unique structural and operational design would preferably call for the elimination of a single rotary piston of triangular or other appropriate configuration structured to be operative within and at least partially sealingly engage the interior surfaces of a combustion/expansion chamber. Moreover, the structure, configuration, dimensioning and design of one or more operating chambers associated with a proposed and preferred rotary engine should be clearly distinguishable from the well known Wankel engine or various attempted modifications thereof. Further, the elimination of a single rotary piston would allow for a vastly improved piston assembly clearly distinguishable in both structure and operation from the single rotary piston of the type generally described above and commonly associated with Wankel-type rotary engines. Finally, the performance characteristics of a newly proposed and preferred rotary I.C. engine should demonstrate sufficient efficiency over an extended operable life to favorably compete on a commercial basis with all types of power plants structured for use in combination with motorized vehicles. Such an increase in efficiency and durability would be at least partially attributable to the elimination or significantly reduced reliance on common operative components such as, but not limited to, crank shafts, connecting rod shafts, rocker arms, valves, valve lifters, pushrods, connecting assemblies, gaskets, oil pumps, etc.

SUMMARY OF THE INVENTION

The present invention is directed to a rotary internal combustion engine uniquely designed and structured to overcome the long recognized disadvantages and problems associated with known and conventional rotary I.C. engines. Moreover, the efficiency and performance characteristics of the rotary I.C. engine of the present invention are such as to render it favorably competitive, not only with existing rotary I.C. engines, but also with reciprocating piston engines, which are prevalent in the powering of motorized vehicles.

In addition, and as will be pointed out in significant detail hereinafter, the rotary I.C. engine of the present invention eliminates and/or significantly minimizes the need for conventional cooling fluid such as water, coolant, oil, etc., as well as minimizes the use of processed or synthetic lubricants to reduce friction between moving parts. In contrast, the cooling of the subject rotary engine is accomplished by directing intake air along predetermined intake flow paths located at least partially externally of the operating chambers of the rotary engine and further directing the cooling, intake air into the interior of the operating chambers without derogatorily affecting the conventional intake, compression, ignition and exhaust phases of an engine cycle.

More specifically, a preferred embodiment of the rotary I.C. engine of the present invention comprises at least one, but preferably a plurality of two operating chambers, each having an interior comprising a toroidal path of travel along which an interactive piston assembly travels during the accomplishment of the aforementioned engine cycle and the powering of a drive shaft of like power take-off. As such, the rotary engine of the present invention eliminates the need of a single rotary piston operatively associated with the internal surfaces of a combustion/expansion chamber, such as is prevalent in the Wankel engine an other rotary engines. Also the structural and operational features of the rotay enging of the present invention eliminates the need for many operative components normally associated with reciprocating engines including, but not limited to, the crank shaft, connecting rod shaft, rocker arms, valves, valve lifters, pushrods, connecting assemblies, gaskets, oil pumps, etc.

As will be apparent from a more detailed description of the structural components and operating characteristics hereinafter provided, the rotary engine of the present invention operates similar to a two stroke engine but is distinguishable there from in that the interactive piston assembly associated with each chamber is moving in a circular path along their respective toroicial paths of travel. This results in a more efficient operation due at least in part to the driving force generated by interaction between the pairs of first and second pistons associated with each chamber; wherein the driving force is always tangential to the central cylindrical shaft or power take-off. In addition, the path of travel of each piston, during an engine cycle is generally three to seven times longer than with conventional piston engines having a similar diameter. As a result, a larger amount of thermal energy is converted into mechanical work. By way of example, there are four power strokes per chamber caused by interaction of the pairs of first and second pistons of each chamber for every one full rotation of the central shaft or power take-off. As a result, the preferred incorporation of two chambers operatively connected to a common central cylindrical shaft or power take-off results in eight power strokes. It should be further noted that the pressure before the ignition phase of each power stroke can be varied between ten and forty bar (0.987 Standard Atmosphere) which is generally twice the pressure range of a conventional diesel engine. This pressure range results in a more complete burning of the air/fuel mixture. In addition, the resulting high pressures may accomplish self ignition of the air/fuel mixture, wherein the specific fuel utilized may vary and include gasoline, propane, diesel, etc.

More specifically, each of the two operating chambers includes an interior comprising a path of travel having a continuous, toroidal configuration. In addition, an interactive piston assembly comprising at least a first piston and a second piston but most preferably including a pair of first pistons and a pair of second pistons concurrently travel in a rotational direction along the toroidal path of travel of each chamber. The pair of first or "driven" pistons is disposed in substantially opposed relation to one another and are each connected to a common cylindrical drive shaft or like power take-off centrally disposed relative to the toroidal path of travel. This central shaft or power take-off is connected to and driven by both pairs of first pistons, each pair of first pistons movable within different ones of the two operating chambers. As such, the structure of the central shaft is fixedly connected to the two pairs of first pistons so as to be driven thereby during the forced rotation of the two pairs of first pistons along the respective toroidal paths of travel.

As set forth above, the interactive piston assembly also includes a pair of second or "drive" pistons concurrently movable with and relative to the corresponding pair of first pistons in each of the separate chambers. Each pair of second pistons is rotational about the central shaft or power take-off by virtue of an interconnecting bearing assembly associated therewith. As such, each pair of second or driving pistons is positionable in driving relation to a corresponding pair of first or driven pistons in each of the chambers such that corresponding pairs of first and second pistons are cooperatively structured and relatively disposed to "interact" in accomplishing intake, compression, ignition and exhaust phases of an engine cycle. As indicated above, the engine cycle comprising these phases is repeatedly performed within corresponding ones of the chambers so as to accomplish forced travel of each pair of first or driven pistons along the toroidal path of travel of the respective chambers.

Further structural features of the rotary internal combustion engine of the present invention which are particularly directed to the construction of each of the preferably two chambers include the provision of an intake assembly and an exhaust assembly, each structured to define fluid communication between the interior and exterior of the respective chambers. The intake assembly and the exhaust assembly are functionally and structurally cooperative with the construction of each of the chambers. More specifically, each chamber includes an intake segment and an exhaust segment cooperatively structured and disposed and defines a significant portion of each of the chambers as well as the toroidal path of travel on the interior of the respective chambers.

Additional details of the intake segment comprise the provision of a plurality of inlets and an equal number of admission windows. Each of the inlets are preferably rectangular in shape and are disposed in fluid communication between an exterior of the chamber and an intake flow path. The intake flow path of each chamber is disposed to direct the travel of the intake air along and at least partially exteriorly of the chamber. The intake air or other intake fluid passes through the inlet along the aforementioned intake flow path to a corresponding admission window located downstream of the inlet. Further, the admission window is disposed in direct communication between the intake flow path and the interior of the chamber and the toroidal path of travel of the interactive piston assembly.

Somewhat similarly but in contrasting operation, the exhaust segment of each chamber includes a plurality of evacuation windows disposed in fluid communication between the toroidal flow path of travel on the interior of the chamber and an exhaust flow path extending along an exterior portion of the chamber. A plurality of outlets, each of which are located at the receiving end of a different exhaust flow path are further disposed in communicating relation with the exterior of the chamber and/or housing surrounding both of the chambers.

Unique performance characteristics and operational features of the rotary internal combustion engine of the present invention also include the incorporation of a locking assembly which momentarily fixes the position of the pair of second pistons along the toroidal path of travel immediately prior to and concurrently with the ignition phase of the engine cycle. The energy resulting from the combustion of the air/fuel mixture is transferred to the pair of first or driven pistons connected in driving relation to the central shaft or power take-off. As will also be explained in greater detail hereinafter, a restricting assembly is operatively positioned in interconnecting relation between the pair of second pistons and a portion of the chamber or associated part thereof. As such, rotation of the pair of second pistons along the toroidal path of travel results in a momentary and/or temporary biasing and "slowing" of the pair of second pistons into a restricted position. Such restriction of the movement or travel of the pair of second pistons along the corresponding toroidal path of travel accomplishes the creation of potential energy in the restricted pair of second pistons. However, sufficient force is eventually exerted on the pair of second pistons, by the first pair of pistons, to facilitate the compression phase through which the pair of second pistons pass prior to the ignition and power strokes which results in the driving of the pair of first pistons and the central shaft or power take-off.

As indicated above, the rotary internal combustion engine of the present invention includes a multi-component housing disposed in surrounding and at least partially outwardly spaced relation to the plurality of chambers. More specifically, the housing includes a mounting cylinder, an intake cylinder and an exhaust cylinder, all of which facilitates passage of intake air and exhaust fluid respectively into and out of the operating chambers. Internal and external threaded covers serve to operatively interconnect the two operating chambers of the rotary engine as well as facilitate the intake and exhaust of appropriate gases to and from the operating chambers.

These and other objects, features and advantages of the present invention will become clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
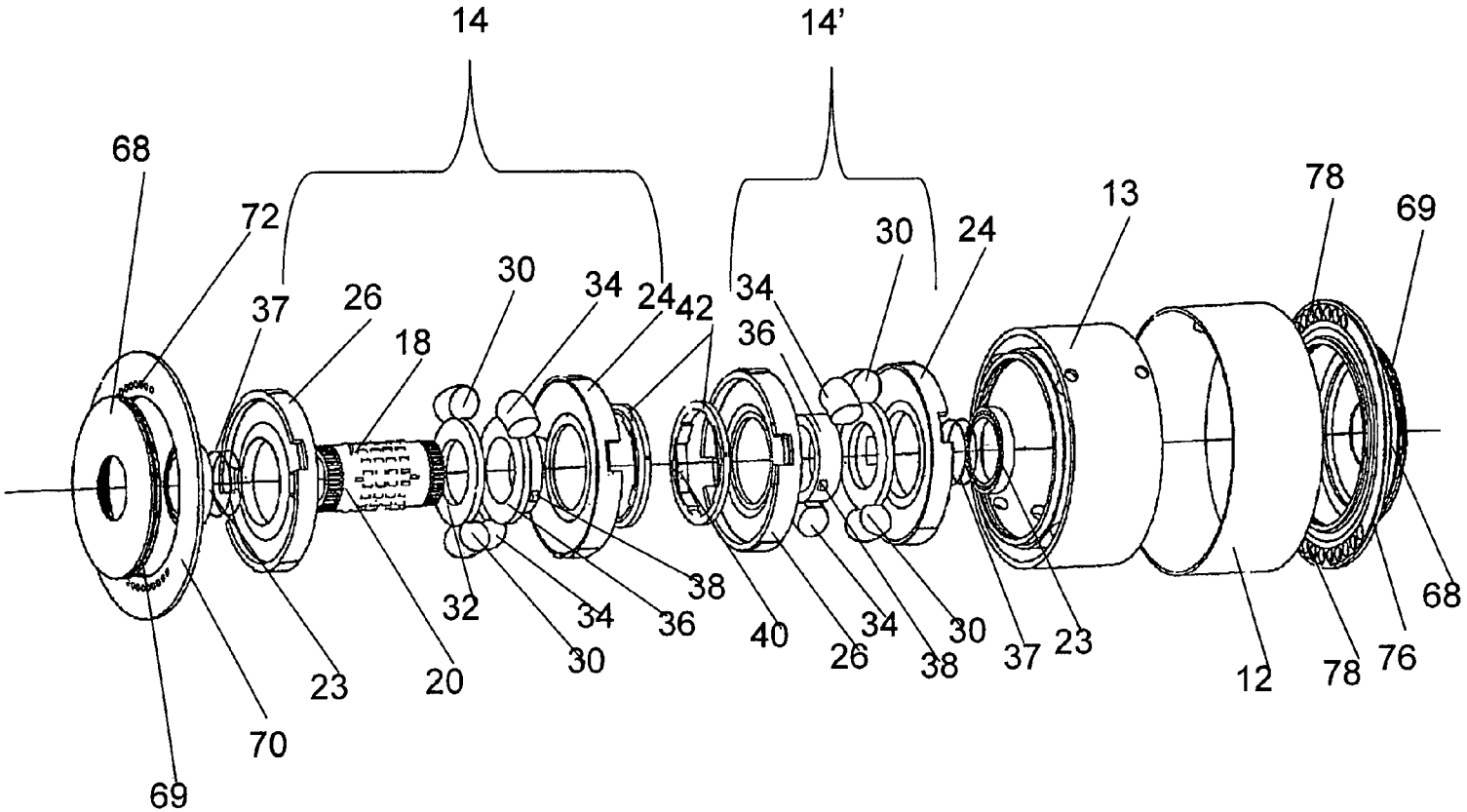
FIG. 1 is a perspective exploded view in schematic form of the various operative components of one preferred embodiment of the rotary internal combustion engine of the present invention being unassembled and comprising two operating chambers.

The present invention is directed to a rotary internal combustion engine generally indicated as 1 which is uniquely structured to overcome the long recognized disadvantages and problems associated with conventional rotary I.C. engines. In addition, the operating and performance characteristics of the rotary I.C. engine of the present invention compares favorably with reciprocating internal combustion engines prevalent as the power source for motorized vehicles. As represented throughout the accompanying Figures, the rotary internal combustion engine 1 of the present invention represented in an unassembled, exploded view in FIGS. 1 and 2 and in an at least partially assembled perspective view of FIG. 24, includes a housing generally indicated as 12 structured to include at least one but preferably two operating chambers 14 and 14', wherein each of the operating chambers includes an interior structured to define a path of travel for one of two interactive piston assemblies respectively indicated by as 16 and 16', wherein the path of travel comprises a toroidal configuration.

With reference to the accompanying Figures, the various operative components of each operating chamber 14 and 14' are equivalent and accordingly the description of the operative components of one of the two operating chambers 14 or 14' is intended to be descriptive of the operative components of both operating chambers. Further, as also demonstrated throughout the accompanying Figures, each of the operating chambers 14 and 14' includes an interactive piston assembly 16 and 16' which are cooperatively structured to develop a driving force transmitted to a common central cylindrical shaft 18, which is also descriptively referred to herein as the power take-off 18. Moreover, while the various embodiments of the rotary internal combustion engine of the present invention operate similar to a two-stroke engine, it will be made clear that one full rotation of the central shaft or power take-off 18 is a result of four power strokes for each operating chamber. Accordingly, a total of eight power strokes are produced for each full rotation of the central shaft or power take-off 18 due to the fact that the interactive piston assembly 16 and 16' associated with each operating chamber 14 and 14' operate in consort to drive the common, central shaft or power take-off 18.

Figure 2:
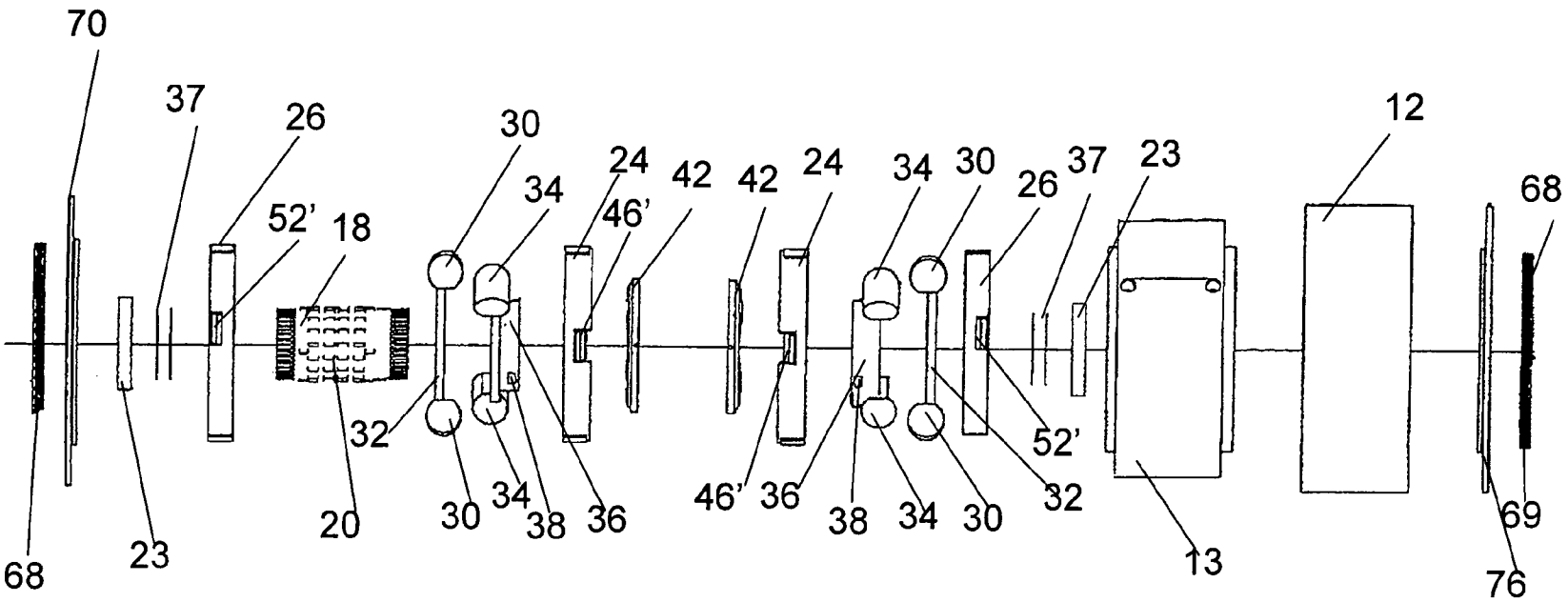
FIG. 2 is a front exploded view of the embodiment of FIG. 1.
Figure 3:
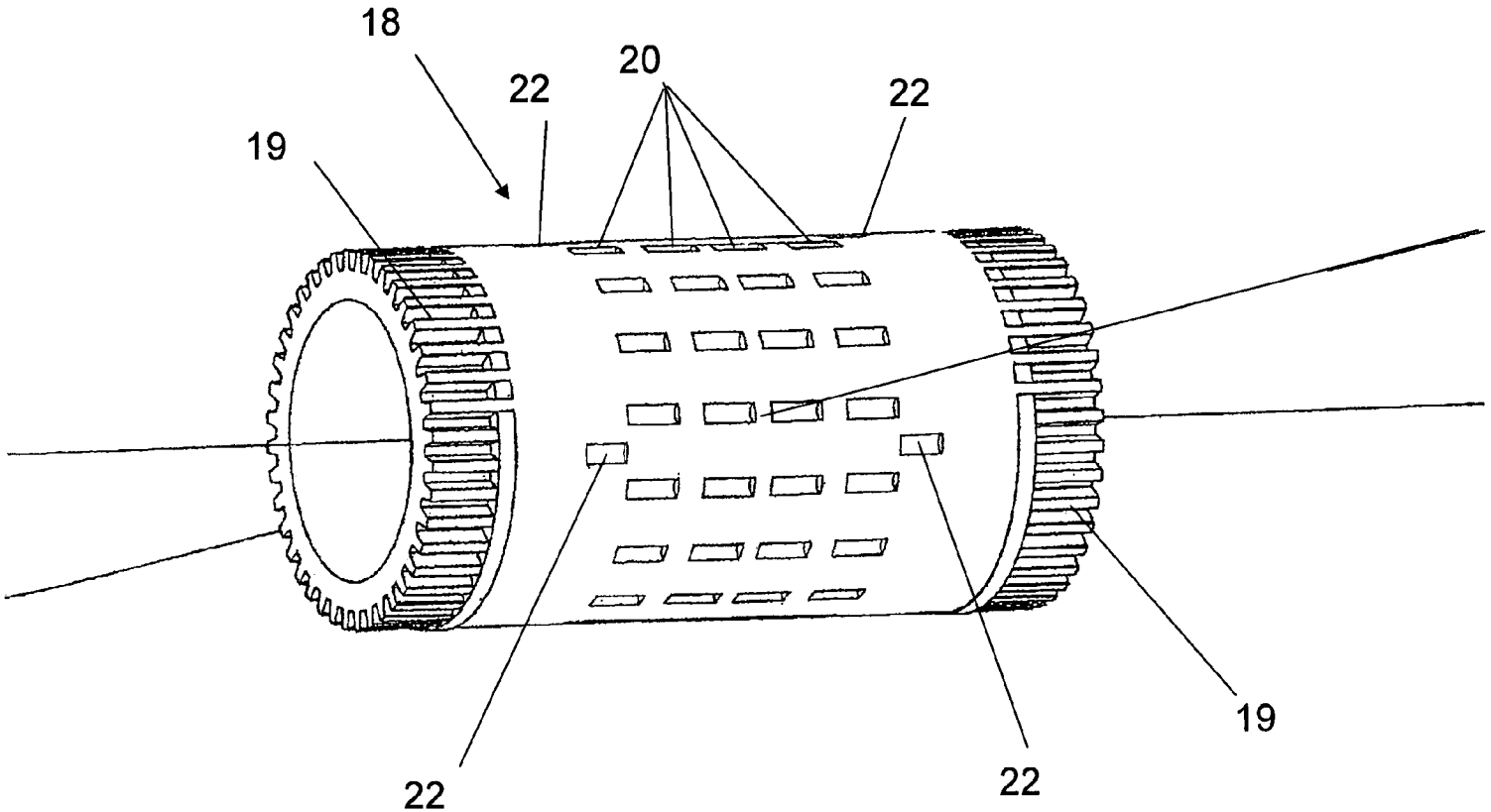
FIG. 3 is a detailed perspective view of one operative component associated with the preferred embodiment of FIGS. 1 and 2.

Again, with primary reference to FIGS. 1 through 3, the power take-off 18 comprises a rimmed exterior surface preferably including a plurality of teeth 19 formed on predetermined portions thereof. In addition, the central shaft of the power take-off 18 comprises bearing assemblies 20 and 22 as well as a plurality of rows of "rolls" which act as a "feather" locking mechanism for additional portions of each operating chamber. The bearing assemblies 20 are disposed and structured to movably interconnect disks 36 of each of the second pair of pistons 34 to the power take-off 18. Similarly, bearing assemblies 22 are disposed and structured to facilitate interconnection between the power take-off or cylindrical shaft 18 and the disks 32 of each of the two pairs of first pistons of the interactive piston assembly 16 and 16', as also will be explained hereinafter. Also, a main bearing assembly 23 may be disposed and structured to further facilitate interconnection of appropriate portions of each of the interactive piston assemblies 16 and 16' to the power takeoff 18.

Figure 4:
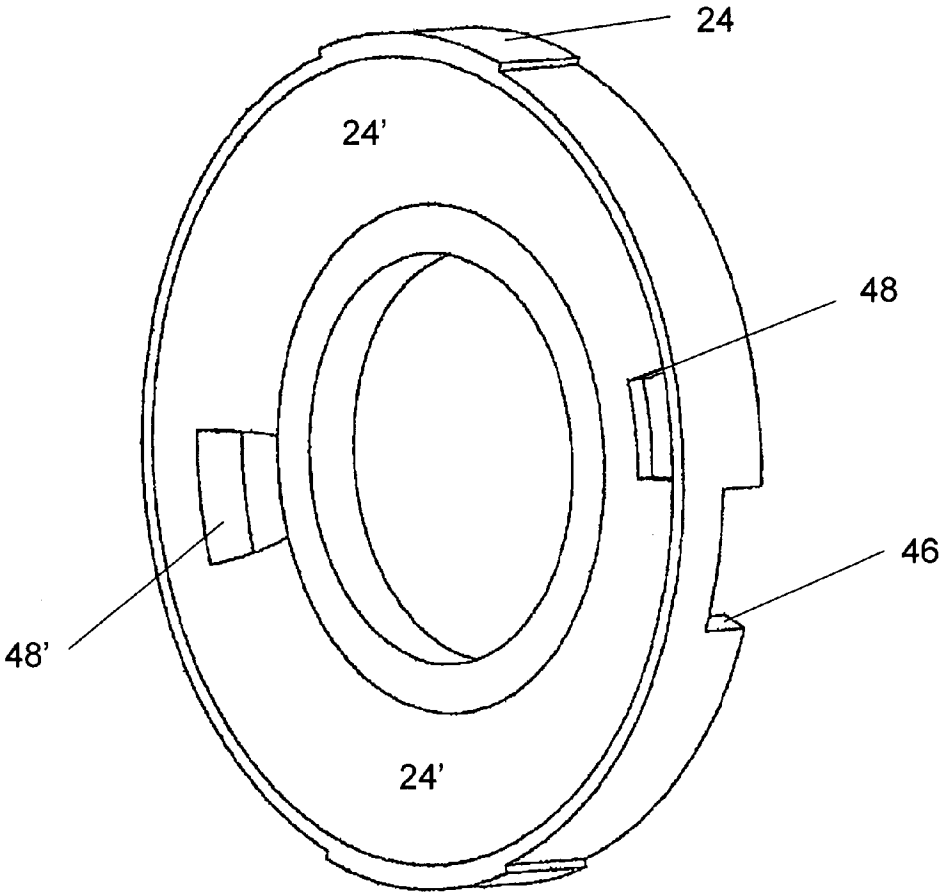
FIG. 4 is a detailed perspective view of another operative component of the embodiment of FIG. 1.
Figure 6:
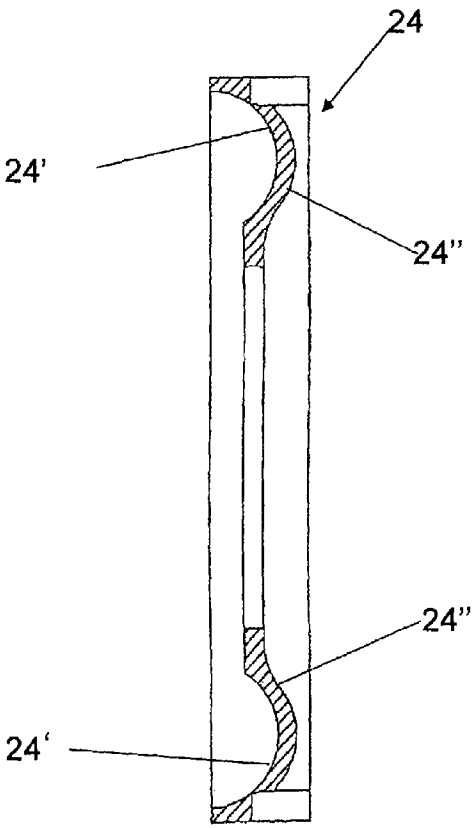
FIG. 6 is a cross sectional view of the embodiment of FIGS. 4 and 5.
Figure 8:
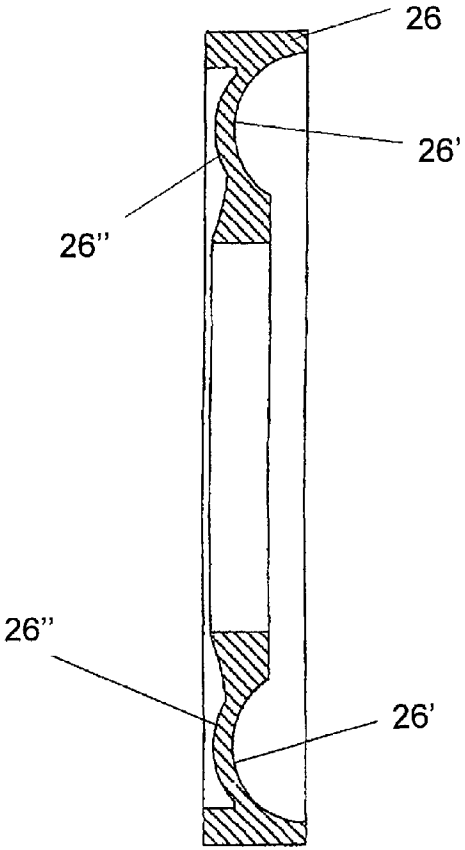
FIG. 8 is a cross sectional view of the embodiment of FIG. 7.
Figure 9:
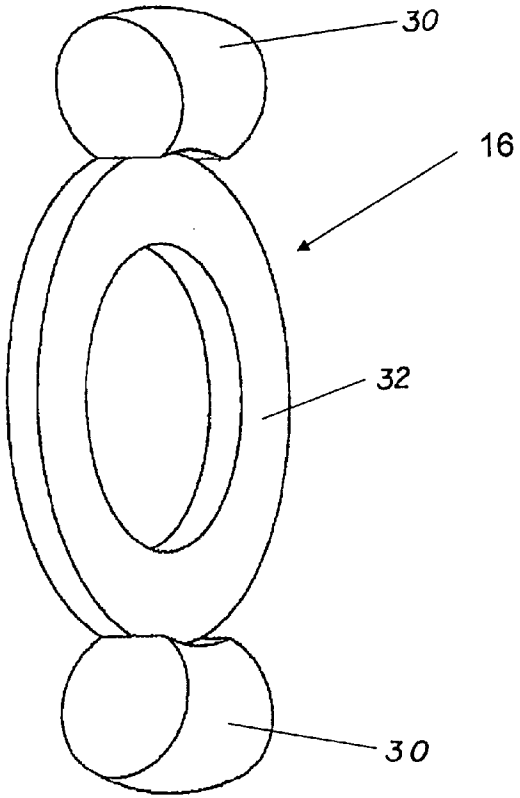
FIG. 9 is a detailed perspective view of a first piston assembly which comprises one component of an interactive piston assembly of the present invention.
Figure 10:
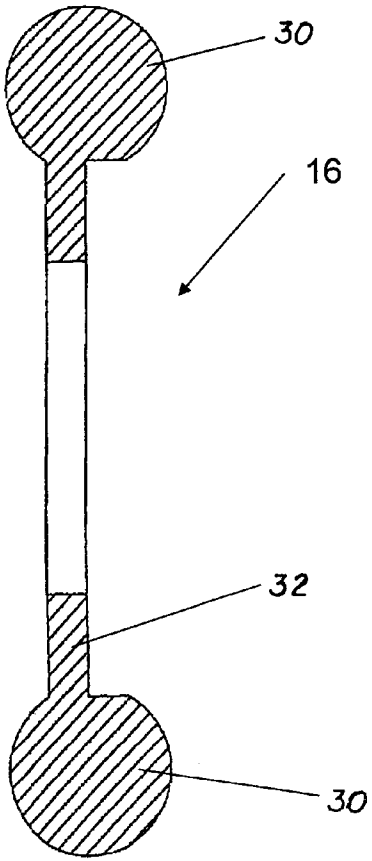
FIG. 10 is a sectional view of the embodiment of FIG. 9.
Figure 11:
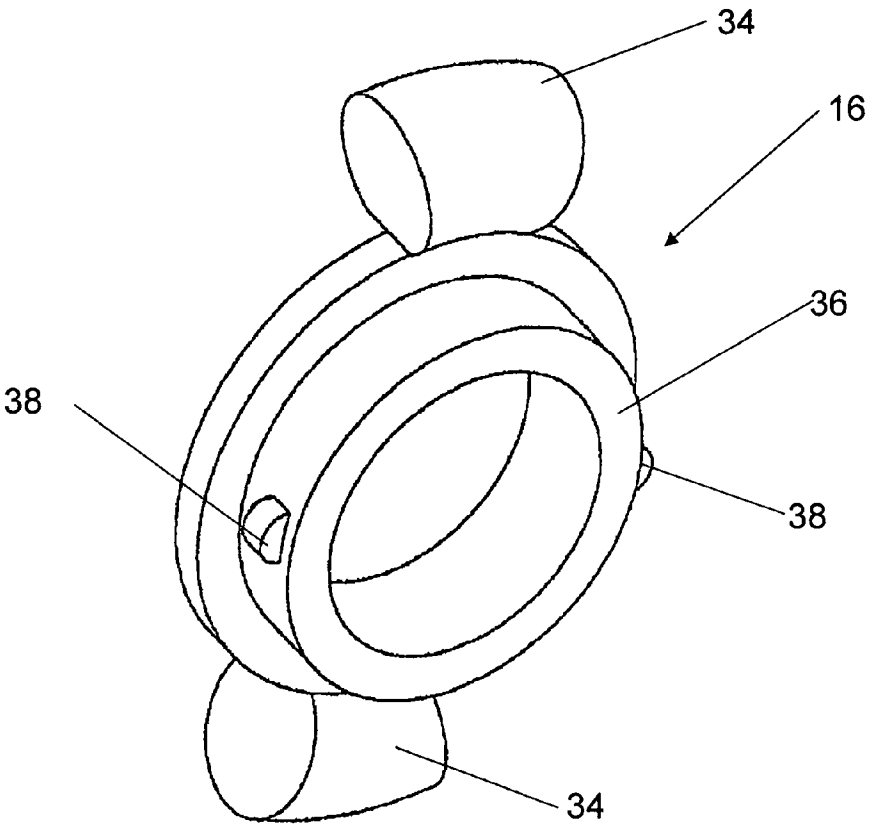
FIG. 11 is a perspective view in detail of a second piston assembly which comprises another component of the interactive piston assembly of the preferred embodiment of the present invention.
Figure 12:
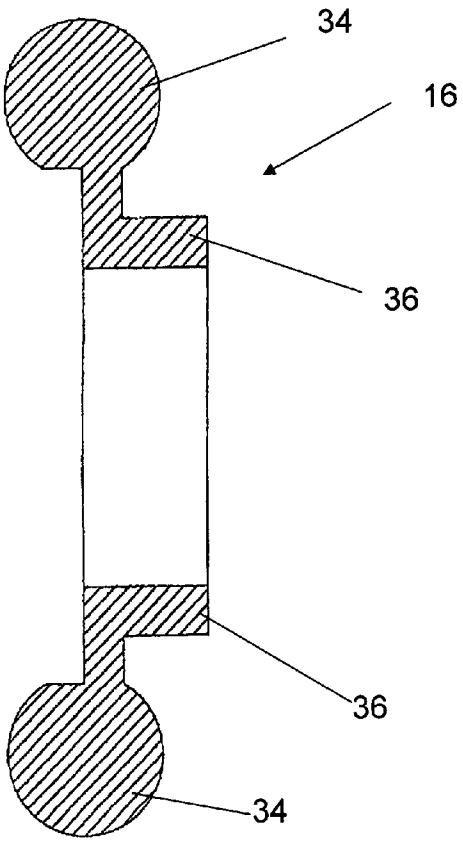
FIG. 12 is a sectional view of the embodiment of FIG. 11.

As set forth above, the interior of each of the operating chambers 14 and 14' is shaped to define a toroidal path of travel along which a corresponding one of the interactive piston assembly 16 or 16' continuously rotates during operation of the rotary I.C. engine of the present invention. Each chamber 14 and 14' comprises a structure which defines both an intake assembly and an exhaust assembly. Moreover, an intake segment 24 and an exhaust segment 26 which when assembled are cooperatively structured to define both of the operating chambers 14 and 14'. Further, the intake segment 24 has an interior surface configuration 24' (see FIGS. 4 and 6), which is dimensioned and configured to define the toroidal path of travel, along with the substantially equivalently shaped interior surface 26' (see FIG. 8) of the exhaust segment 26. The interactive piston assemblies 16 and 16' can continuously rotate along the respective toroidal paths of travel on the interior of corresponding operating chambers 14 and 14', during continuous operation of the rotary I.C. engine 1. It is again emphasized that description of the individual working components as represented in the various Figures are intended to be descriptive of each/all of the equivalent components associated with each of the operating chambers 14 and 14', wherein each operating chamber 14 and 14' is equivalently structured to concurrently operate in the powering of the central shaft or power take-off 18.

Each of the interactive piston assemblies 16 and 16' preferably includes, a pair of such first or driven pistons 30 as represented in FIGS. 1–2, 10–11, 14 and 15. Each of the first pistons 30 may also be accurately described and referred to as "driven pistons". As demonstrated the pair of first pistons 30 is fixedly secured to a disc 32, in generally opposing relation to one another. The disc 32 is fixedly secured to the central shaft or power take-off 18 so as to rotate therewith, in driving relation thereto.

Figure 15:
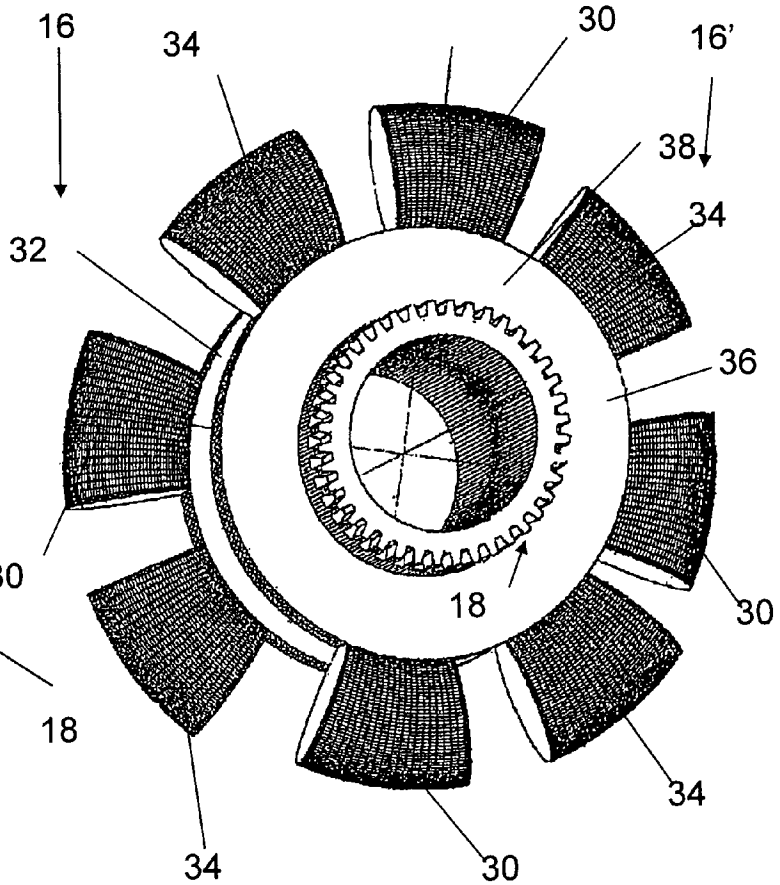
FIG. 15 is a side perspective view of the embodiment of FIG. 14.
Figure 14:
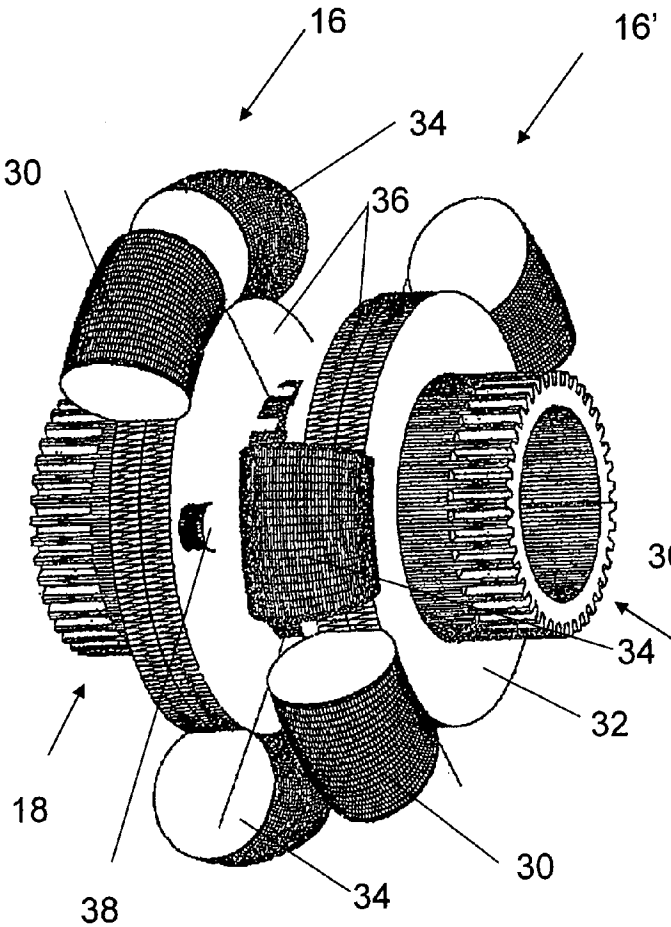
FIG. 14 is a perspective view in schematic form showing the relative positions of two interactive piston assemblies associated with different operating chambers as disclosed in the embodiments of FIGS. 1 and 2.
Figure 16:
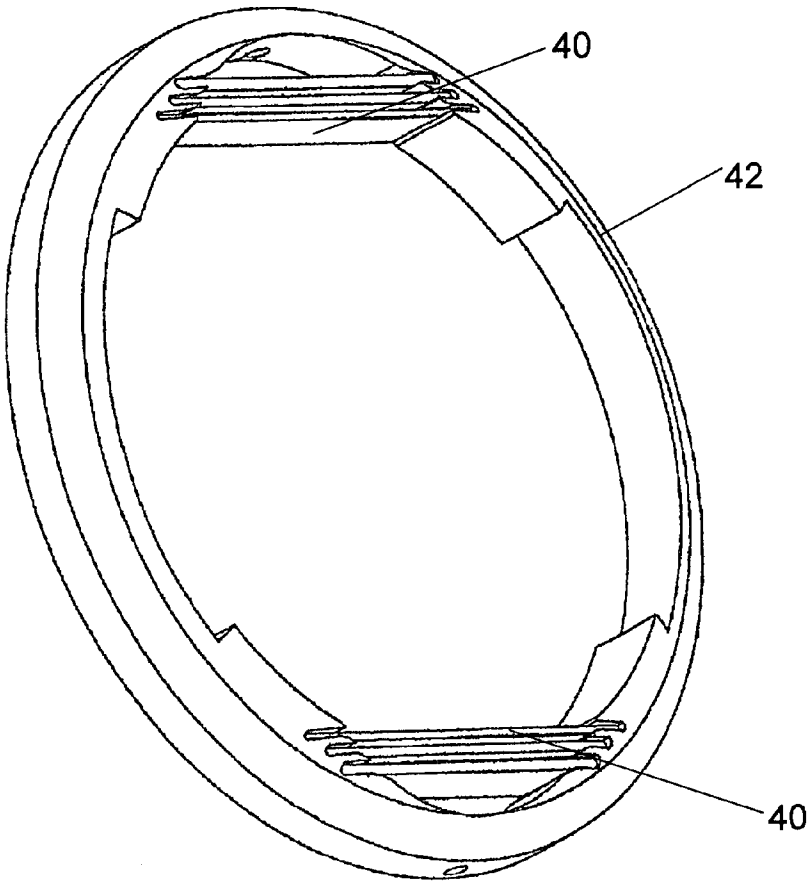
FIG. 16 is a detailed perspective view of yet another operative component of the embodiment of FIGS. 1 and 2.
Figure 17:
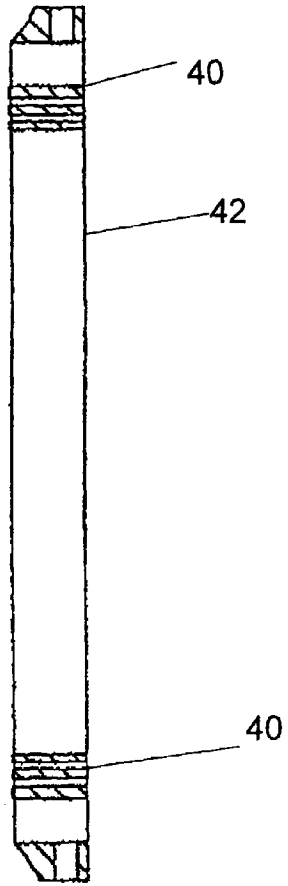
FIG. 17 is a sectional view of the embodiment of FIG. 16.
Figure 18:
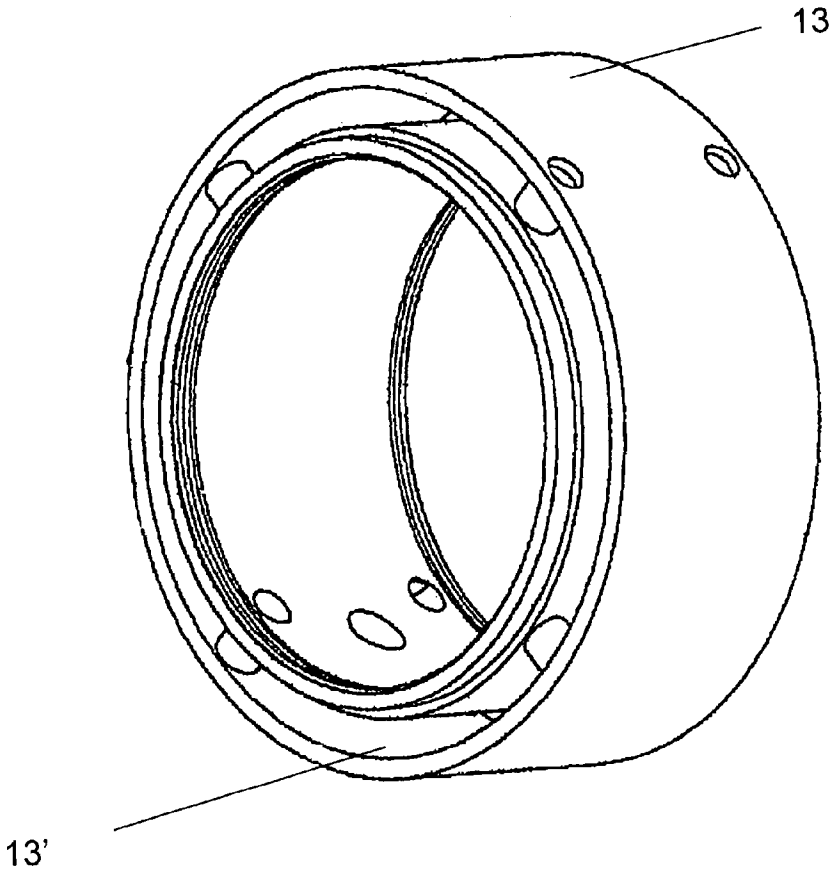
FIG. 18 is a detailed perspective view of combined operative components of the preferred embodiment of FIGS. 1 and 2 of the present invention.
Figure 19:
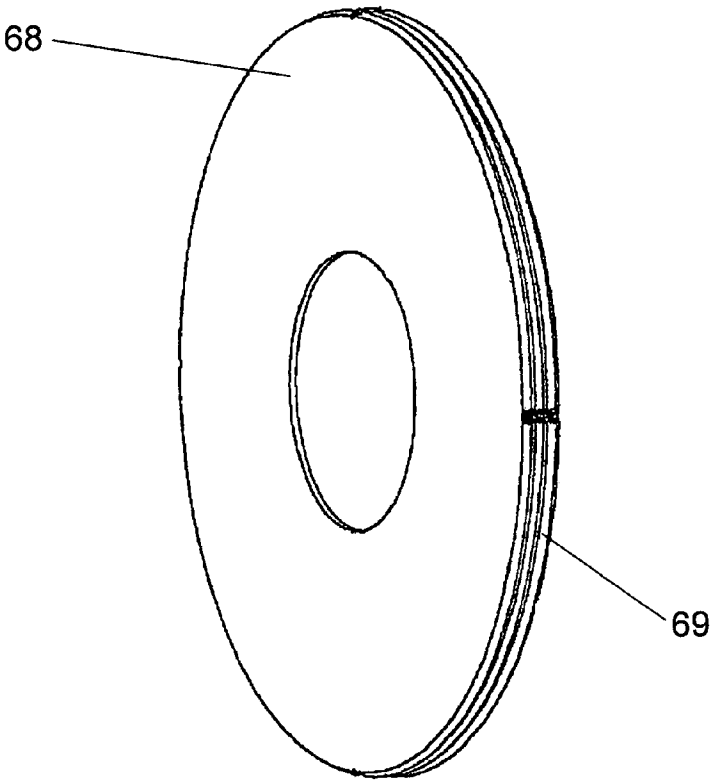
FIG. 19 is a detailed perspective view of yet another operative component of the preferred embodiment of FIGS. 1 and 2
Figure 20:
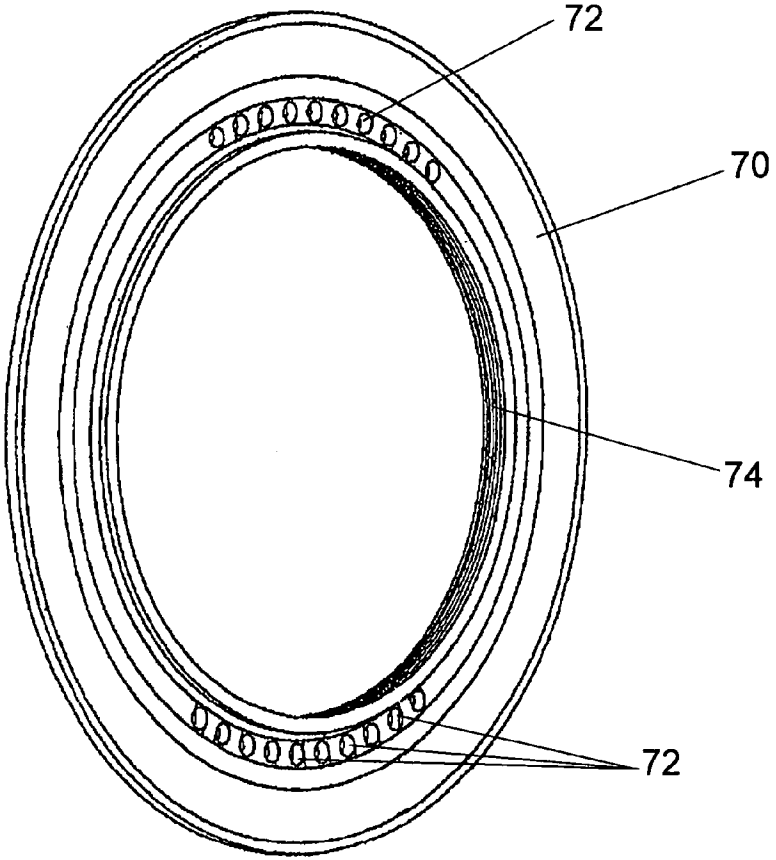
FIG. 20 is detailed perspective view of yet another operative component of the preferred embodiment of FIGS. 1 and 2.
Figure 21:
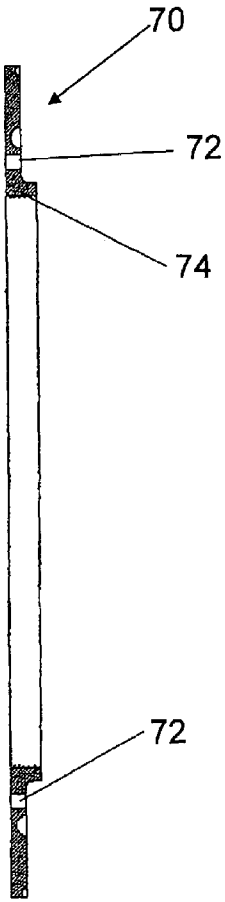
FIG. 21 is a sectional view of the embodiment of FIG. 20.
Figure 22:
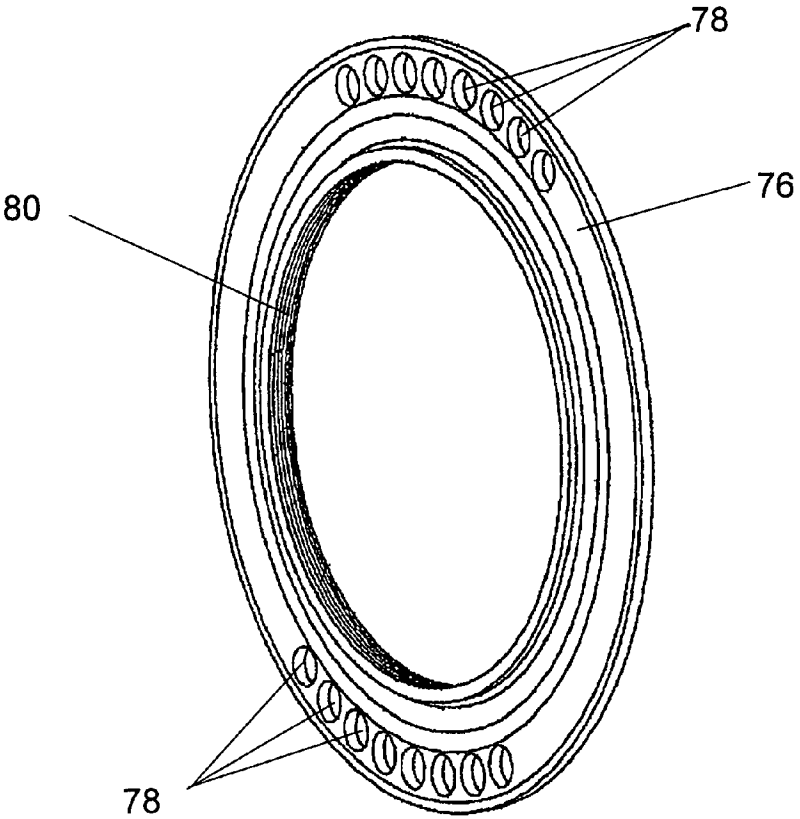
FIG. 22 is a detailed perspective view of yet another operative component of the preferred embodiment of FIGS. 1 and 2.
Figure 23:
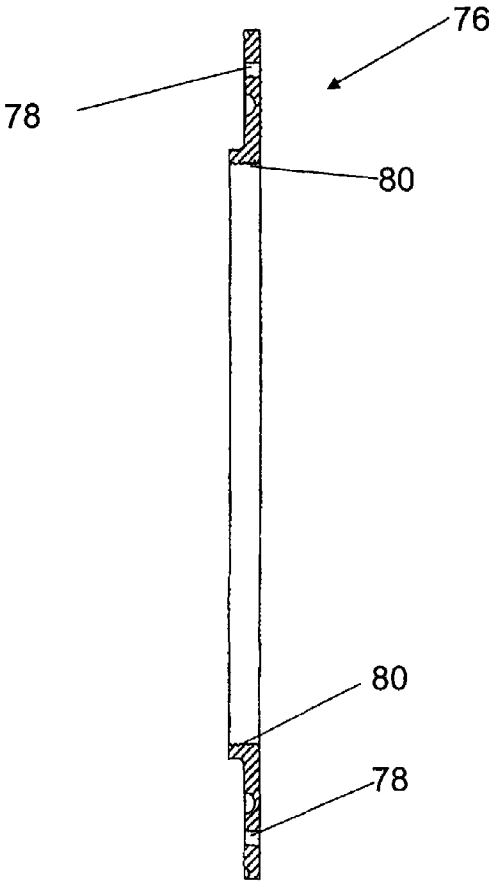
FIG. 23 is a sectional view of the embodiment of FIG. 22.

Each of the interactive piston assemblies 16 and 16' also preferably includes a pair of second pistons or driving pistons 34 fixedly secured to the mounting structure 36 which, as described above, is rotationally mounted on the central shaft or power take-off 18 by virtue of the interconnecting bearing assemblies 20. Therefore, when operatively connected and assembled as represented in FIGS. 14 and 15, each interactive piston assembly 16 and 16' preferably comprises a pair of first pistons 30 connected in driving relation to the power take-off 18 and a pair of second pistons 34 rotationally connected to the power take-off 18 but concurrently traveling along a common toroidal path of travel as the pair of first pistons 30 and in substantially driving relation thereto within the same operating chamber 14 or 14'. As will be further indicated herein, each pair of second pistons 34 are movable relative to the corresponding pair of first pistons 30 by virtue of the second pistons 34 being movably attached to the power take off. As such each pair of second pistons 34 can be said to "rock" between the corresponding pair of first pistons 30 because the spacing between corresponding pairs of first and second pistons will vary during the different phases of the engine cycle, as the interactive piston assemblies 16 and 16' travel along the respective toroidal paths of travel.

As should be apparent, the embodiments of FIGS. 14 and 15 represent the interactive piston assemblies 16 and 16'assembled in their operative relation to one another but absent the additional assembly of the intake segment 24 and the exhaust segment 26. When fully assembled, the intake segment 24 and exhaust segment 26 structurally define, at least in part, the operating chambers 14 and 14' when assembled in surrounding, enclosing relation to the respective interactive piston assemblies 16 and 16'. The cooperative interaction of the pair of first pistons 30 and pair of second pistons 34 will be described in detail with reference to the sequential operating steps demonstrated schematically in FIGS. 25A–25B through 38A–38B as the interactive piston assemblies 16 and 16' pass through at least one engine cycle. As will also be apparent from a detailed description of these Figures, each engine cycle associated with the preferred embodiments of the rotary I.C. engine 1 of the present invention incorporates intake, compression, ignition and exhaust phases. Moreover, a plurality of engine cycles, each including the aforementioned phases, is repeatedly accomplished, preferably four times, for each full revolution of the power take-off 18 during operation of the rotary I.C. engine 1.

Additional structural features incorporated within the rotary I.C. engine 1 and directly associated with the operation of the interactive piston assemblies 16 and 16' of each operating chamber 14 and 14' include a restricting assembly comprising at least one but preferably a pair of restricting members 38. The restricting members 38 are disposed on the mounting member or disc 36 supporting the pair of second pistons 34. The restricting members 38 are disposed in a predetermined spaced relation to one another such as being disposed in substantially opposing relation to one another. The restricting assembly also includes a plurality of blocking assemblies 40, corresponding in number to that of the restricting members 38 and operatively positioned for cooperative and preferably concurrent interaction therewith. Each of the blocking assemblies preferably comprises a biasing structure which in at least one preferred embodiment may be more specifically defined by a blade spring. Each of the two blocking assemblies or biasing structures 40 is connected to an end disc 42 as represented in FIGS. 1, 2, 16 and 17.

Figure 39:
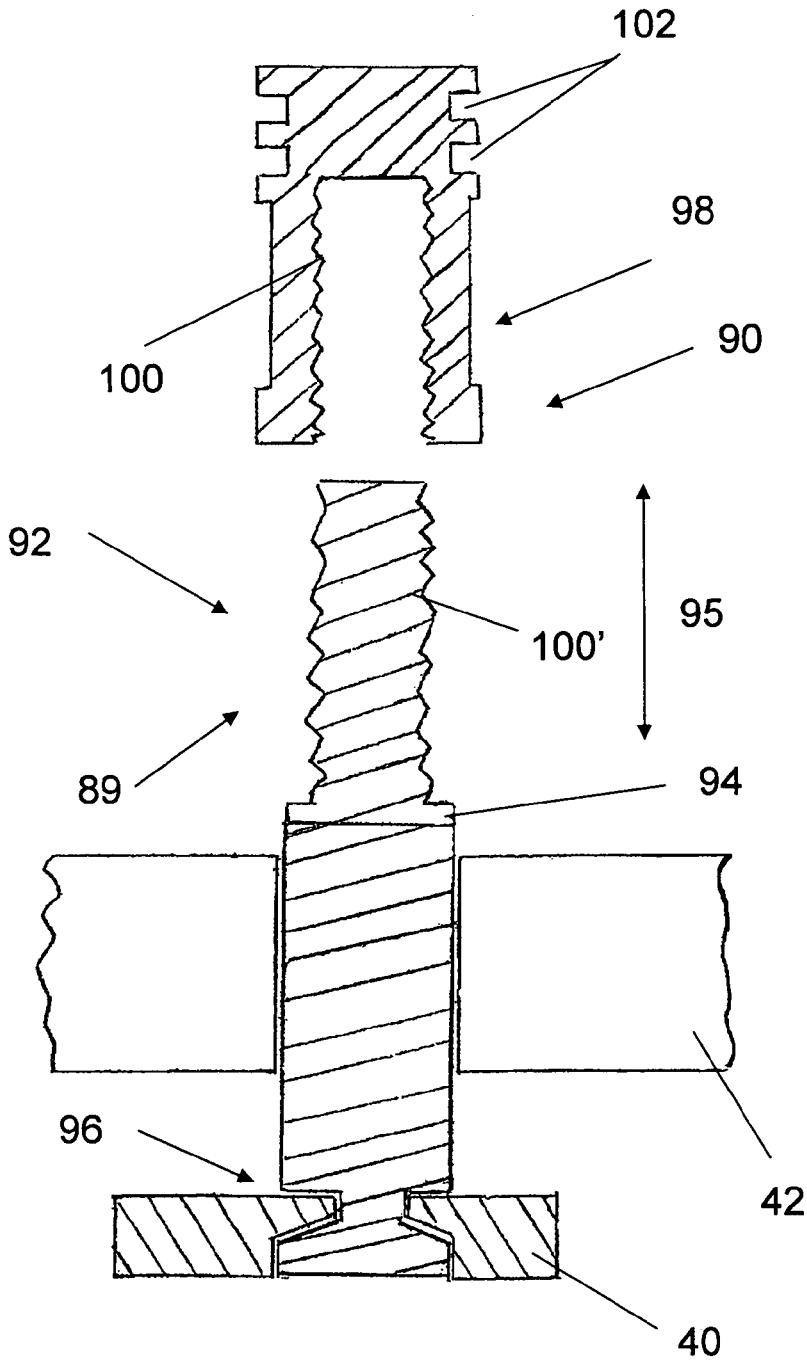
FIG. 39 is an exploded view in cross section and partial cutaway of yet another preferred embodiment of the present invention comprising a fuel delivery assembly.

As will be described, the restricting members 38 periodically engage the blocking assemblies or biasing structures 40 during the rotation of the pair of second piston assemblies 34 along a corresponding toroidal path of travel. Interaction between the restricting members 38 and the blocking assemblies or biasing structures 40 provides a momentary and temporary "slowing" or a restricting of the movement of the pair of second pistons 34 in order to build up sufficient "potential energy". This potential energy is used to enhance the efficiency of the compression phase of the aforementioned engine cycle, which occurs immediately before the ignition phase and the accompanying power stroke associated therewith. Further, the disc member 42 can be rotationally adjusted or otherwise rotated approximately 45 degrees relative to the corresponding operating chamber 14 and 14' with which it is associated. This rotational adjustment allows for restriction of travel of each of the pair of second pistons 34 at approximately zero degrees and 180 degrees along the toroidal path of travel and in cooperative position to the ignition phase of the aforementioned engine cycle. As will also be explained hereinafter, the biasing assembly 40 associated with each of the operating chambers 14 and 14' are disposed and structured to operatively regulate the injection of an air/fuel mixture or explosive mixture by a timed activation of a fuel delivery assembly 90, mounted on disk member 42 and disclosed in detail in FIGS. 38 and 39.

Figure 5:
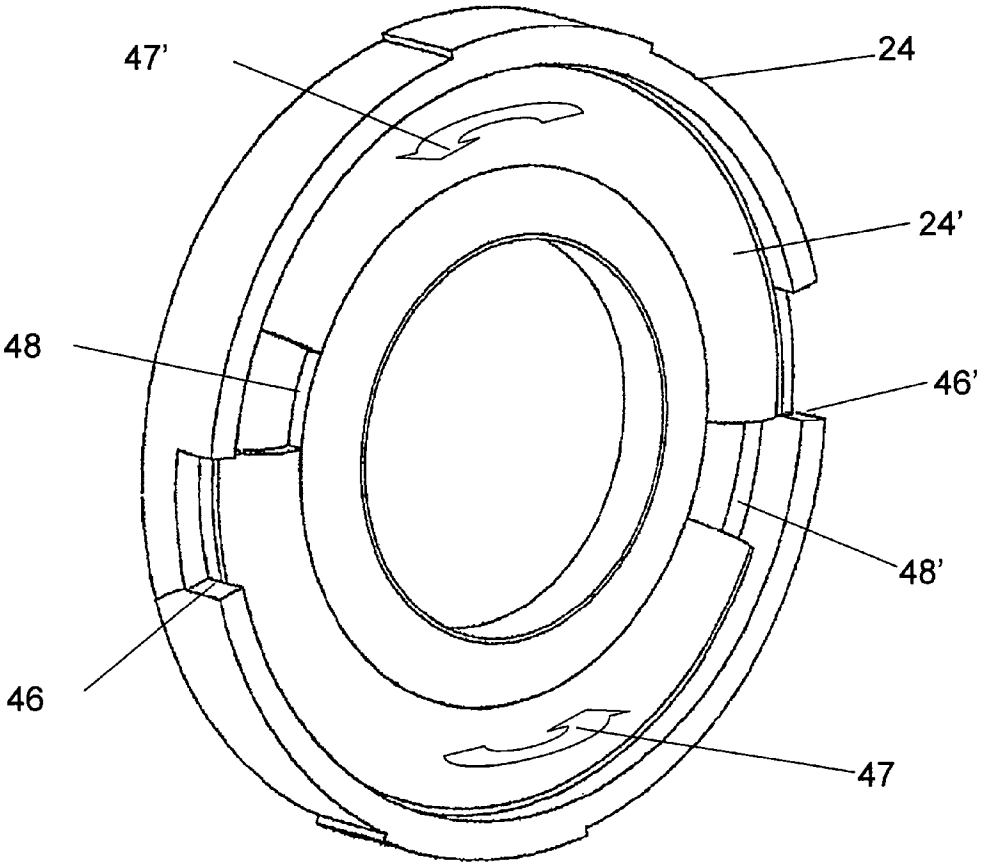
FIG. 5 is a rear perspective view of the embodiment of FIG. 4.

As set forth above, the rotary, I.C. engine 1 of the present invention comprises an intake assembly and an exhaust assembly. The intake assembly is at least partially defined by the intake segment 24 of the operating chamber 14 or 14'. With primary reference to FIGS. 4 through 6, the intake segment 24 includes a plurality of intake openings 46 and 46' which are cooperatively disposed relative to a plurality of admission windows 48 and 48' also formed in the intake segment 24. Cooperating ones of the inlets 46 and 46' and the admission windows 48 and 48' define an intake flow path 47 and 47' there between. As demonstrated in FIG. 5, each of the preferably two intake flow paths 47 and 47' is formed along the exterior surface 24" of the intake segment 24 and along a correspondingly disposed portion of the exterior of the toroidal path of travel. Accordingly, air or other intake fluid from the exterior of the operating chamber 14 initially passes into the each of the inlets 46 and 46' and along a corresponding one of the intake flow paths 47 and 47'. More specifically, the air entering the intake 46 will travel along the exterior surface 24" at least partially defining intake flow path 47 and exit from the downstream admission window 48' into the interior of the operating chamber 14 or 14' and into the toroidal path of travel in operational relation to the interactive piston assembly 16. Similarly, the air entering the intake 46' will travel along the exterior flow path 47' and exit through the corresponding admission window 48 into a corresponding one of the operating chambers 14 or 14'.

It is important to note that the intake air or other intake fluid traveling along each of the intake flow paths 47 or 47' serves as a cooling medium to the corresponding operating chamber 14 or 14' even though it travels, at least partially, on the exterior of the intake segment 24. However, once reaching the corresponding admission window 48 or 48', the cooling intake fluid enters the interior of the operating chamber 14 or 14' and continues its cooling process as it travels effectively along an interior portion of the corresponding toroidal path of travel. It is further emphasized the entry of the intake fluid into the toroidal path of travel through each of the admission windows 48 and 48' is "behind" certain ones of the interactive first and second pairs of pistons 30 and 34 and therefore does not derogatorily affect performance of the aforementioned engine cycle. The cooling effect of the intake air or other fluid will be further explained with regard to the sequence of operational steps, schematically represented in FIGS. 25A–25B through 38A–38B.

As indicated above a most preferred embodiment of the present invention comprises preferably two inlets 46 and 46' cooperatively disposed with preferably two admission windows 48 and 48'. Accordingly, two intake flow paths 47 and 47' are formed and provide sufficient cooling of the operating chambers 14 and 14' of the rotary IC engine 1 during the performance of the plurality of engine cycles and revolution of the power take-off 18. As indicated, each of the inlets 46 and 46'preferably comprise a rectangular opening, are disposed in communicating relation with an exterior of a corresponding operating chamber 14 or 14' and the interior of the aforementioned intake flow path 47 or 47'. Similarly, each of the admission windows 48 or 48' are disposed in fluid communication between corresponding ones of an intake flow paths 47 or 47' and the interior of the corresponding toroidal path of travel of the interactive piston assembly 16 or 16' associated therewith.

Figure 7:
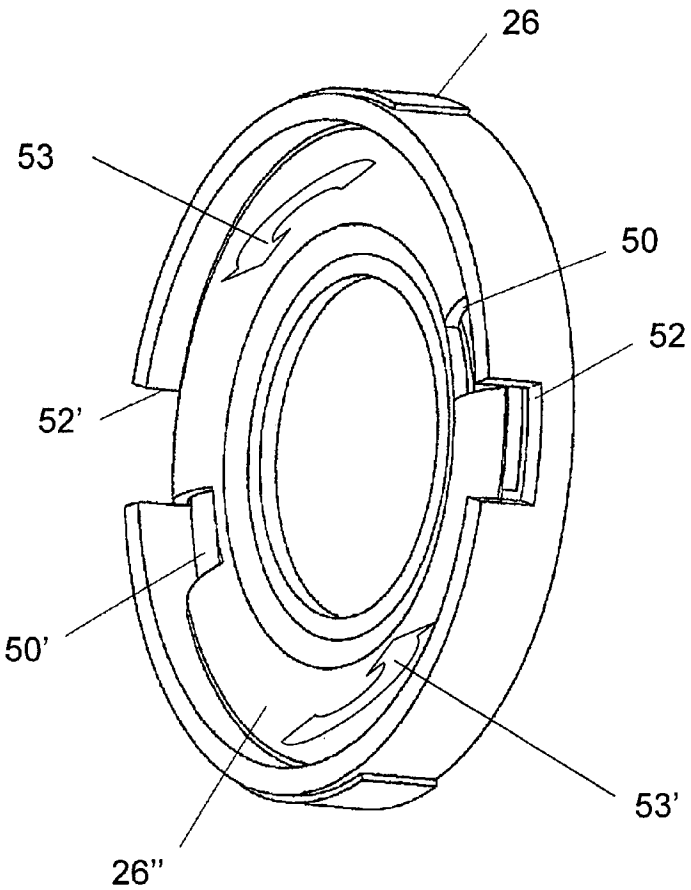
FIG. 7 is a detailed exterior perspective view in detail of another operative component of the embodiment of FIGS. 1 and 2.

Somewhat similarly, but in contrasting function and operation, the exhaust segment 26 (see FIGS. 7 and 8), which defines a part of the exhaust assembly, includes at least one but preferably a plurality of exhaust windows 50 and 50' and an equal number of preferably two, outlets 52 and 52'. The exhaust windows 50 and 50' are similarly dimensioned and configured as are the admission windows 48 and 48'. Further, each of the exhaust windows are disposed in fluid communication between the interior of a corresponding operating chamber 14 and corresponding ones of the exhaust flow paths 53 and 53' extending along the exterior surface 26" between each of the exhaust windows 50 and 50' and a corresponding, cooperatively disposed downstream one of the outlets 52' and 52, respectively. Therefore, the positioning of the exhaust assembly and in particular the respective exhaust windows 50, 50' and associated outlets 52', 52 respectively, serves to remove or vent the exhaust gas, subsequent to ignition, by allowing the exhaust gas to initially pass or be received into the appropriate one of the exhaust windows 50 and 50'. Thereafter, the exhaust gas travels along a corresponding exhaust flow path 53 and 53' located exteriorly of the exhaust segment 26 and also extending along at least an exterior portion of the toroidal flow path but exteriorly thereof. Finally, the exhaust gases exit through a downstream, associated one of the outlets 52' and 52, respectively and are eventually vented to the exterior of the rotary I.C. engine 1 through the housing 12 such as through the mantle ring 13.

Figure 24:
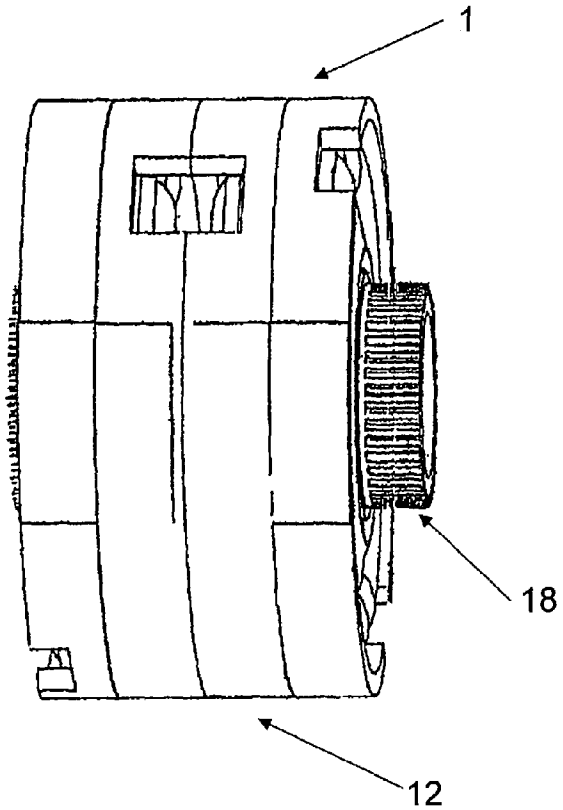
FIG. 24 is a perspective view of the exterior of the preferred embodiments of FIGS. 1 and 2 in an assembled form.
Figure 25A:
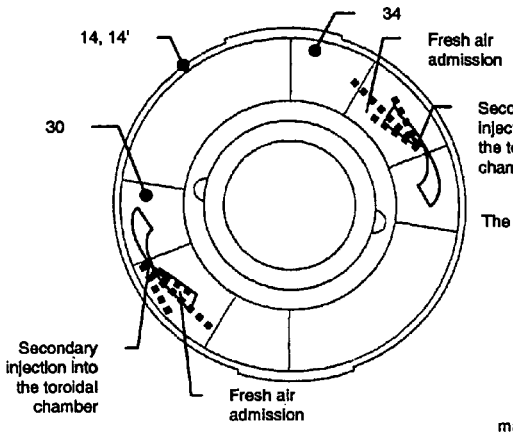
FIGS. 25A and 25B are front and rear schematic views respectively of one of a plurality of sequential, operational steps of one operating chamber of a preferred embodiment of the rotary internal combustion engine of the present invention, demonstrating the operation thereof.
Figure 25B:
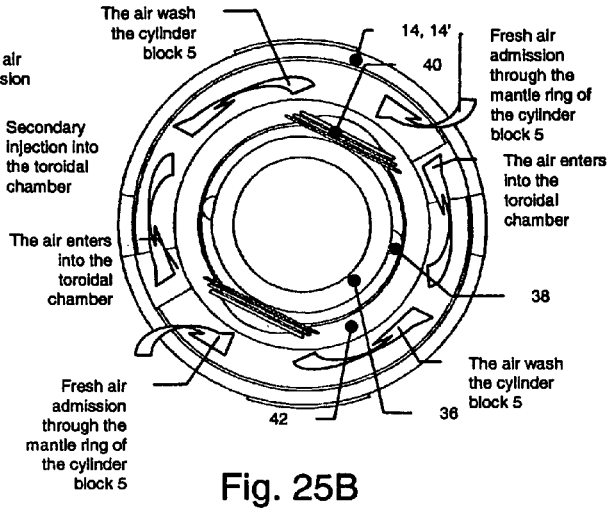
Figure 26A:
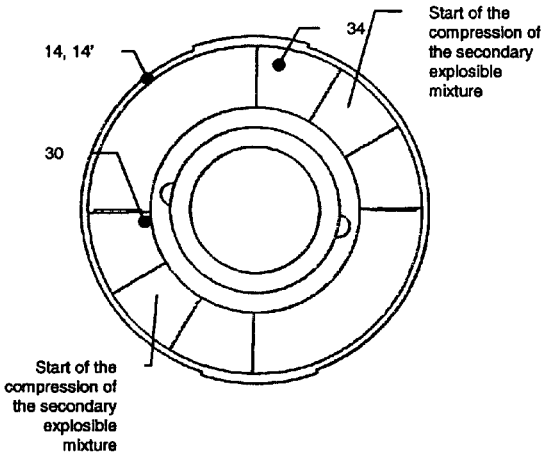
FIGS. 26A and 26B are front and rear schematic views respectively of a next sequential operating step from that shown in FIGS. 25A and 25B.
Figure 26B:
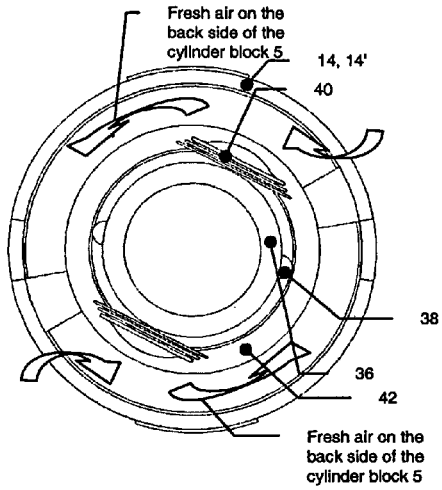

Yet additional structural features of a most preferred embodiment of the present invention are shown generally in FIGS. 1 and 2 and in detail in FIGS. 18 through 23. More specifically, the housing 12 surrounds the mantle ring 13, which in turn, concentrically surrounds and overlies the assembled operating chambers 14 and 14'. Further, the mantle ring 13 is structured to cooperate with the intake assembly and the exhaust assembly at least in terms of providing air flow to and from the operating chambers 14 and 14' at least partially through the hollow annular chamber 13'. Fluid communication or air/exhaust flow between the exterior of the rotary internal combustion engine 1, when assembled as shown in FIG. 24, and the operating chambers 14 and 14' is accomplished through the end plates 70 and 76. Each of the end plates 70 and 76 includes flow through apertures 72 and 78 respectively. The apertures 72 and 78 communicate with interior portions of the mantle ring 13 where the inflow and exhaust of air and exhaust gases pass to and from both of the operating chambers 14 and 14' as well as the respective toroidal flow paths along which the interactive assemblies 16 and 16' travel. The assembly of the rotary internal combustion engine 1 of the present invention is further accomplished by the connecting plates 68 being disposed in a retaining connection with at least the end plates 70 and 76. Such a retaining connection is accomplished by means of external threads 69 disposed and dimensioned to cooperate with internal threads 74 and 80 formed in the end plates 70 and 76 as shown throughout the indicated figures.

Figure 13:
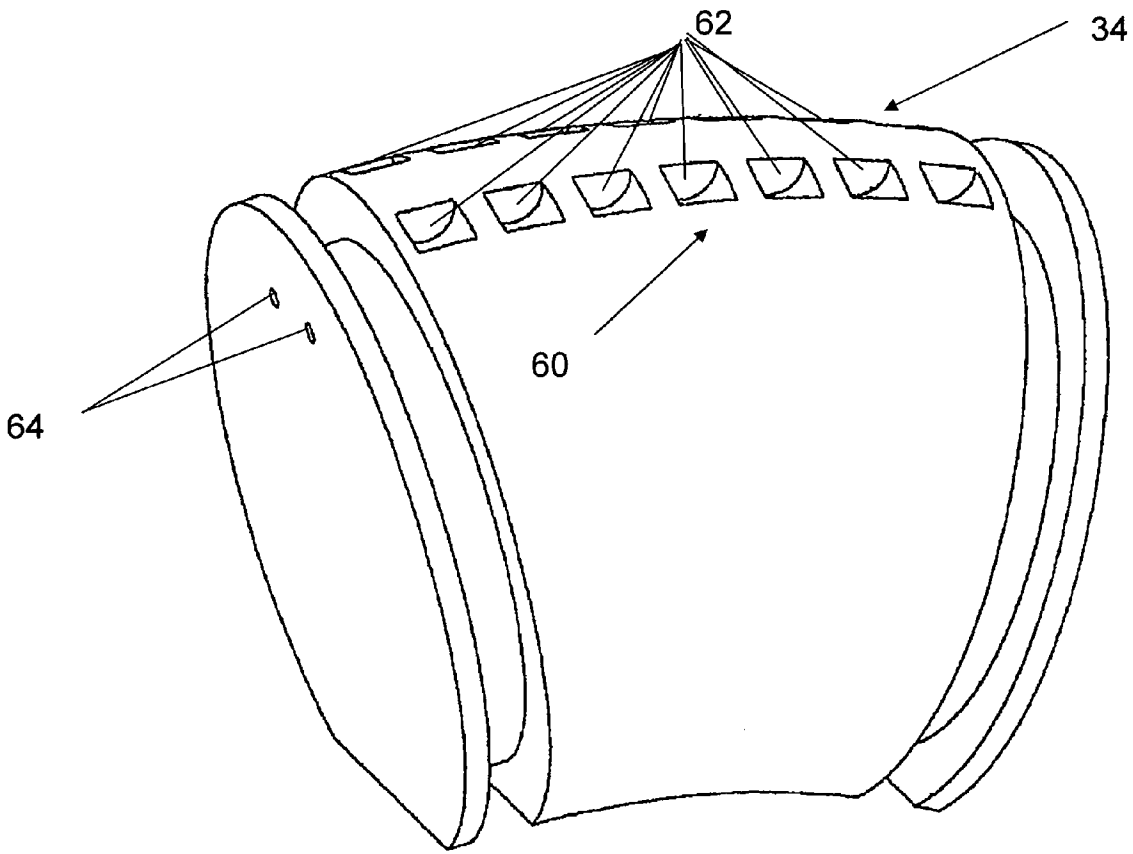
FIG. 13 is a detailed perspective view of one piston of the embodiment of FIGS. 11 and 12.

Another structural and operative feature of the rotary I.C. engine 1 of the present invention comprises a locking assembly generally indicated as 60 and represented in FIG. 13. It is emphasized that the locking assembly 60 differs in both structure and function from the aforementioned and described restricting assembly comprising the restricting members 38 and the blocking assemblies 40. Accordingly, the locking assembly 60 is connected to each of the second pair of pistons 34 and comprises at least one but preferably, a plurality of locking members 62 structured to be positioned between a locked orientation and an unlocked orientation.

In the unlocked orientation each of the plurality of locking members 62 are disposed in a non-protruding relation relative to the outer periphery or outer surface of each one of the pair of second pistons 34. However, when in the locked orientation, each of the plurality of locking members 62 protrude outwardly from the outer periphery or surface of each of the second pistons 34 into a locking engagement with portions of the interior of the respective operating chamber 14 or 14'.

More specifically, when in the locked orientation, the plurality of locking members 62 preferably interact with locking teeth or like projection structures formed on or connected to the intake and exhaust segments 24 and 26 and cooperatively. disposed with the plurality of locking members 62 as the second pistons 34 rotate along the toroidal path of travel. Moreover, the locking teeth or like members are diametrically opposed on the intake and exhaust segments 24 and 26 and extend along a predetermined arcuate length of the toroidal path of travel having an approximate curvilinear dimension of 60 degrees preferably extending from an angular position of 330 degrees to 30 degrees. A second or opposed locking teeth structure extends along an arc of approximately 60 degrees from a position along the toroidal path of travel of from 150 degrees to approximately 210 degrees.

Disposition of the plurality of locking members 62 between the unlocked orientation, wherein the locking members 62 are retracted, and the locked orientation, wherein the locking members 62 are extended, occurs preferably by the introduction of pressurized air or other fluid through inlets 64 formed in an appropriate portion of each of the pair of second pistons 34. Further, the inlets 64 are located in fluid communication with the interior of the toroidal path of travel on the interior of corresponding ones of the operating chambers 14 or 14'. As such, introduction of pressurized air (or other fluid) into the inlets 64 will cause an outward extension or protrusion of the locking member 62 from the unlocked orientation, to the locked orientation. When the plurality of locking members 62 are in the locked orientation, each of the pair of second pistons 34 will be momentarily and temporarily fixed into a locked position along a predetermined portion of the toroidal path of travel. When the locking members 62 are in the unlocked orientation the locking members 62 will be out of contact with potentially interruptive portions of the interior of the chamber 14 and the pistons 34 will be free to rotate along the corresponding toroidal path of travel. Accordingly, the locking assembly 60 functions to assure that the pistons 34 rotate along the toroidal path of travel in a single direction.

As will be explained in greater detail with regard to the successive operational steps of FIGS. 25A through 37B, the locked position of the pair of second pistons 34 occurs substantially concurrently with and during the ignition phase and resulting power stroke of the engine cycle. Further, the temporary and/or momentary locking of the pair of second pistons 34 along a predetermined portion of the toroidal path of travel will cause all of the force or power generated by the ignition of the air/fuel mixture to be transferred to the pair of first pistons 30 causing a forced rotation thereof and a driving rotation of the power take-off 18.

Operation of a most preferred embodiment of the rotary I.C. engine 1 of the present invention will be described with specific reference to the substantially operating sequences schematically represented in FIGS. 25A–25B through 38A–38B. As demonstrated, the first pair of pistons 30 and the second pair of pistons 34 of interactive piston assembly 16 of one of the two operating chambers 14 pass through at least one engine cycle comprising intake, compression, ignition and exhaust phases thereof. It is again emphasized that during the continuous operation of the rotary I.C. engine 1, each complete revolution of the % power take-off 18, involves four power strokes per operating chamber 14 and 14'. This results in a total of eight power strokes for each complete revolution of the power take-off 18, due to the fact that the interactive piston assembly 16 and 16' of each of the operating chambers 14 and 14' work in concert and serve to continuously drive the same cylindrical shaft or power take-off 18.

At the beginning of operation the power take-off 18 (see FIG. 24) is engaged by an external starter (not shown) which preferably rotates the power take-off 18 and the pair of first pistons 30 in a counterclockwise direction. Rotation of the power take-off causes a forced rotation of the pair of first pistons 30 into a position to close the exhaust windows 50, 50' while allowing the admission windows 48 and 48' to remain open. As such, air is admitted therethrough under pressure at preferably and approximately 1.5 bar, wherein the point of entry through the admission windows 48 and 48' is in front of the pair of first pistons 30, as demonstrated in FIGS. 25A and 25B. Concurrently, a secondary air fuel mixture enters the toroidal flow path as indicated and described in FIGS. 25A–25B and 26A–26B. Thereafter the pair of first pistons 30 continues to rotate along the corresponding toroidal path of travel and close the admission windows 48 and 48'.

Figure 27A:
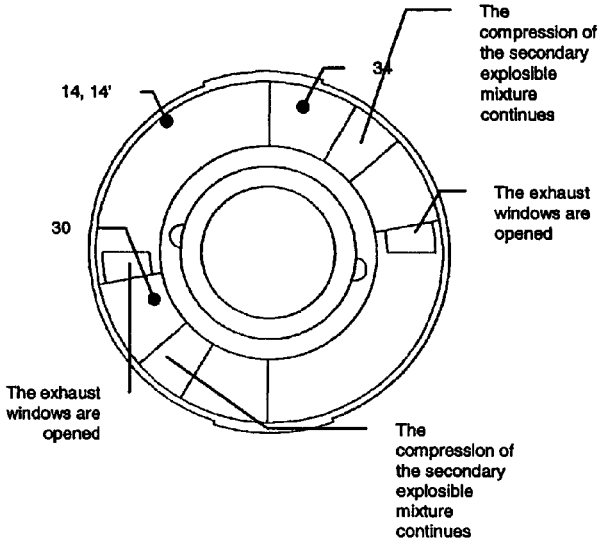
FIGS. 27A and 27B are front and rear schematic views respectively of a next sequential operating step from that shown in FIGS. 26A and 26B.
Figure 27B:
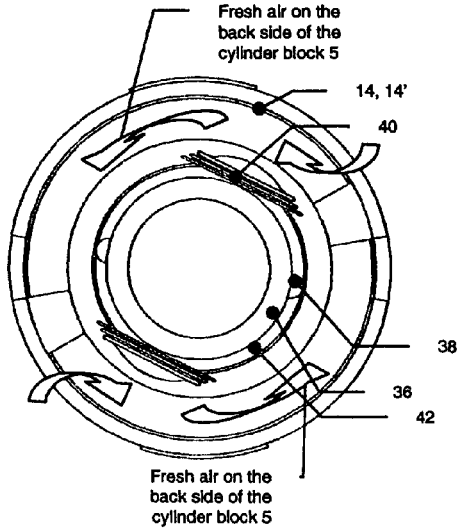
Figure 28A:
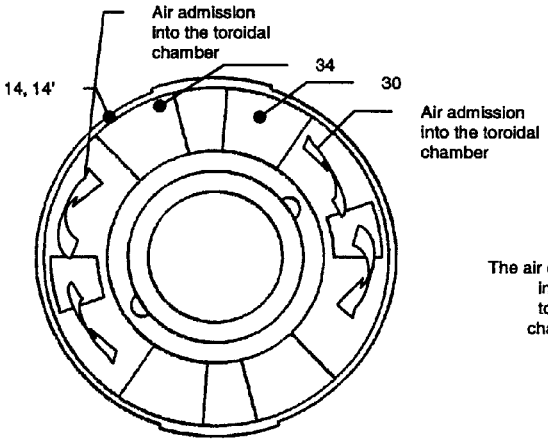
FIGS. 28A and 28B are front and rear schematic views respectively of a next sequential operating step from that shown in FIGS. 27A and 27B.
Figure 28B:
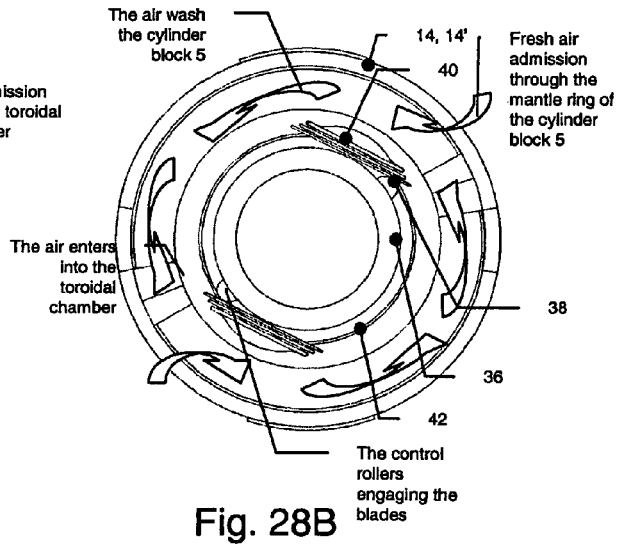

With reference to FIGS. 27A, through 28B, the pressure between the leading end of the pair of first pistons 30 and the trailing end of the pair of second pistons 34 increases, because of a reduced volume or space there between, resulting in the beginning of the movement or rotation of the pair of second pistons 34 along the toroidal path of travel. At this point in the rotation of the corresponding interactive piston assembly 16, the admission windows 48 and 48' are opened. Concurrently, the restricting members 38 rotate to a position where they begin to engage the blocking assemblies or biasing structures 40. Concurrently, intake air passing into the interior of the chamber 14 and along at least a portion of the toroidal path of travel behind the trailing end of the leading pair of first pistons 30 begins the cooling process. As such, corresponding portions of the chamber 14 are cooled as the intake air passes into and along the toroidal path of travel from the aforementioned intake flow paths 47.

Figure 29A:
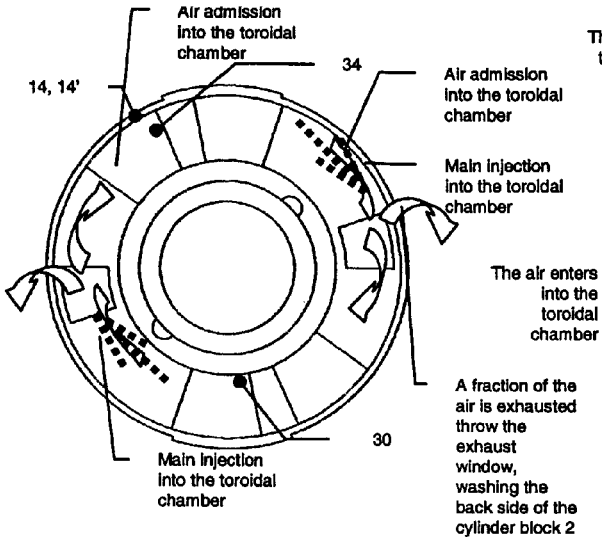
FIGS. 29A and 29B are front and rear schematic views respectively of a next sequential operating step from that shown in FIGS. 28A and 28B respectively.
Figure 29B:
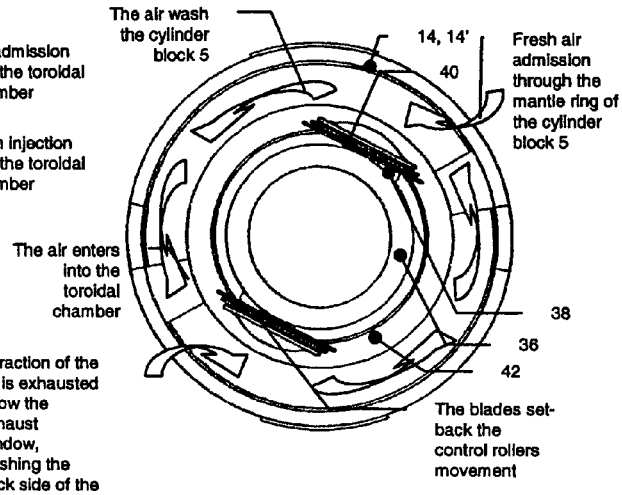
Figure 30A:
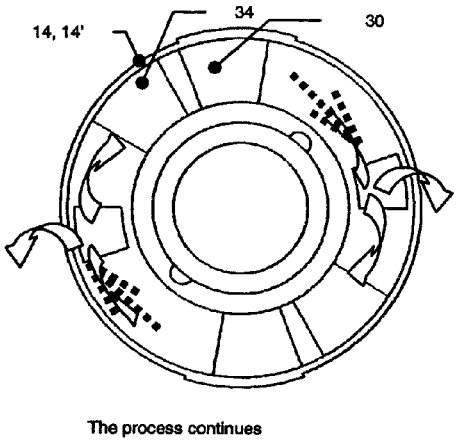
FIGS. 30A and 30B are front and rear schematic views respectively of a next sequential operating step from that shown in FIGS. 29A and 29B respectively.
Figure 30B:
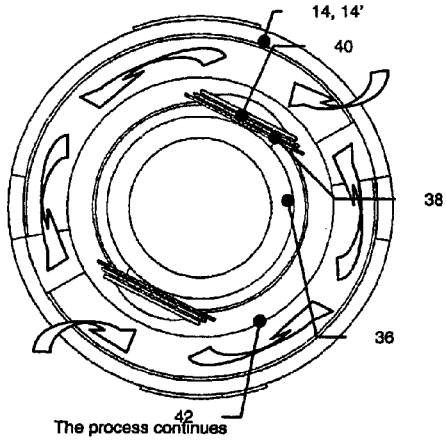
Figure 31A:
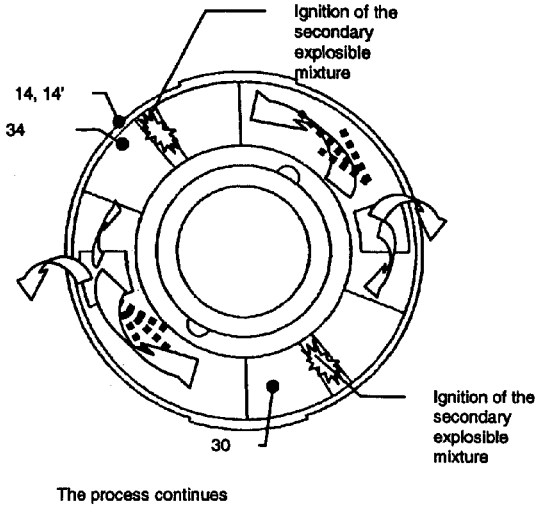
FIGS. 31A and 31B are front and rear views respectively of a next sequential operating step from that shown in FIGS. 30A and 30B.
Figure 31B:
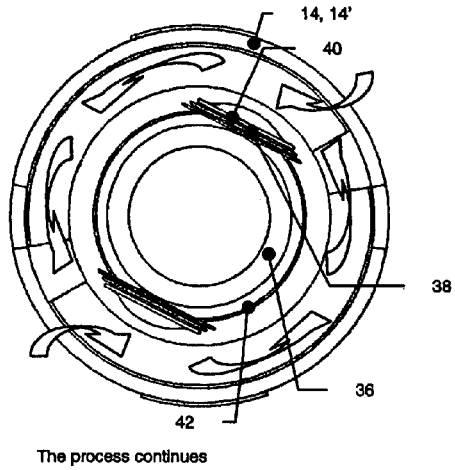
Figure 32A:
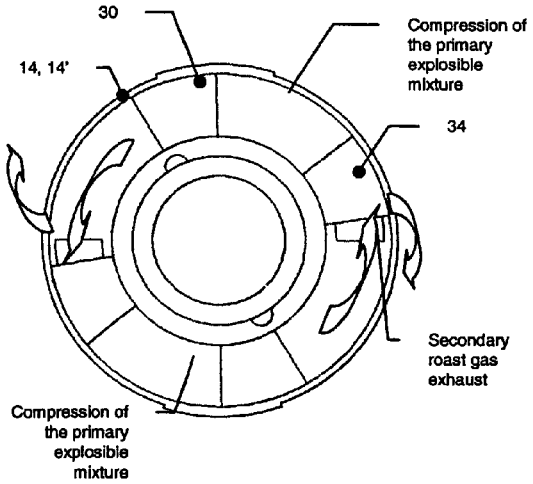
FIGS. 32A and 32B are front and rear schematic views respectively of a next sequential operating step from that shown in FIGS. 31A and 31B respectively.
Figure 32B:
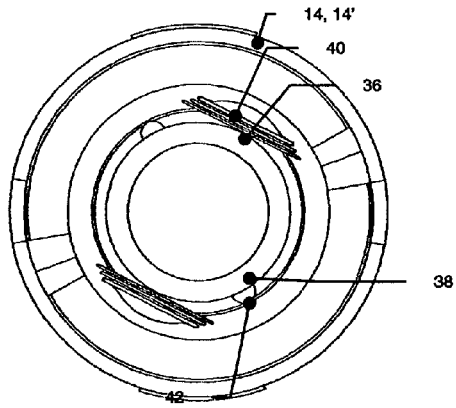
Figure 33A:
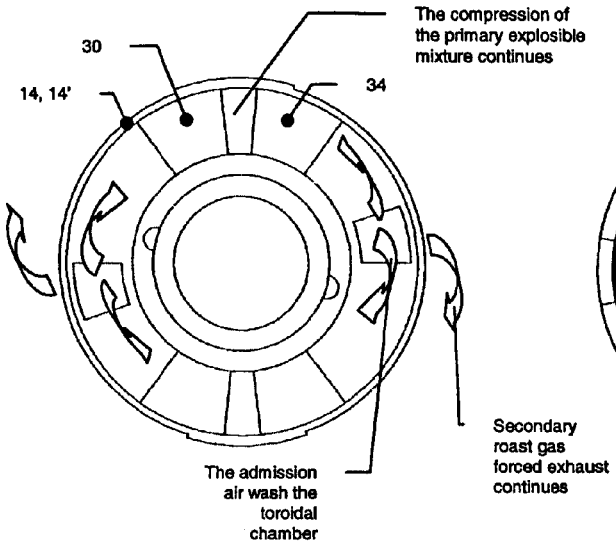
FIGS. 33A and 33B are front and rear schematic views respectively of a next sequential operating step from that shown in FIGS. 32A and 32B.
Figure 33B:
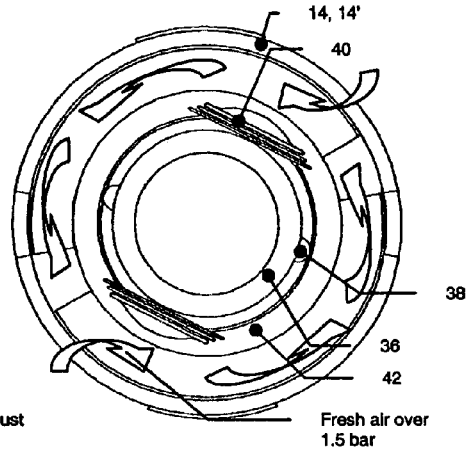

As demonstrated in FIGS. 29A, through 30B, engagement of the restricting members 38 with the blocking assembly and/or biasing structure 40 serves to temporarily restrict the pair of second pistons 34 thereby temporarily and/or momentarily slowing their rotation and building a predetermined amount of potential energy. As further demonstrated, pressure between the trailing side of the second pistons 34 and the leading side of the first pistons builds to sufficient degree to facilitate combustion/ignition of the secondary charge as represented in FIGS. 31A–31B. This ignition of the secondary charge serves to drive the second pair of pistons along the toroidal flow path for compression of the primary charge or explosive charge as demonstrated in FIGS. 32A–32B.

With reference to FIGS. 30A and 30B, the primary air fuel mixture is injected behind the rear end of the pair of first pistons 30 while the cooling process from the intake air, described above, continues. Due to the momentary restriction of movement or rotation of the pair of second pistons 34 because of the interaction of the restricting members 38 and the biasing structures 40, the pressure between the leading end of the first pair of pistons 30 and the trailing end of the restricted pair of second pistons 34, increases to a point where the biasing force momentarily restricting the rotation of the pair of second pistons 34 is overcome. More specifically, the potential energy collected during the restricted travel of the pair of first pistons 34 is "released" and is transferred to rotational energy forcing the pair of second pistons 34 rapidly forward, aided by the secondary ignition, thereby causing a compression of the air/fuel mixture previously injected into the toroidal path of travel.

As demonstrated in FIGS. 32A through 33B, the gas of the air/fuel mixture continues to be compressed due to the forward rotation of the pair of second pistons 34 relative to the pair of first pistons 30, wherein the air/fuel mixture is compressed preferably to approximately 20 bar and to a compression point where it is ready to be ignited, possibly by self ignition. Concurrently, the cooling process with the intake air passing into the interior of the toroidal path of travel through the admission windows 48 and 48' continues but does not interfere or derogatorily effect the various phases of the engine cycle.

Figure 34A:
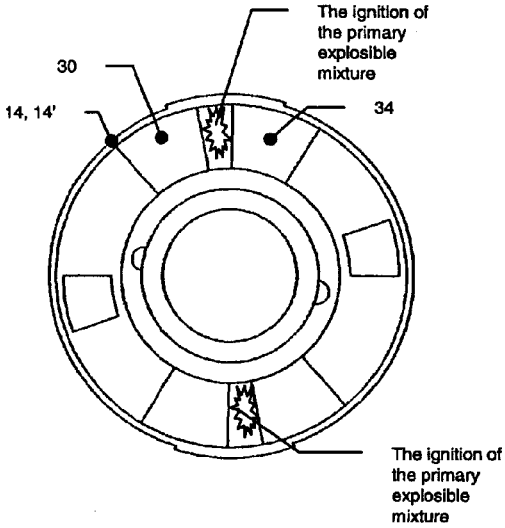
FIGS. 34A and 34B are front and rear schematic views respectively of a next sequential operating step from that shown in FIGS. 33A and 33B respectively.
Figure 34B:
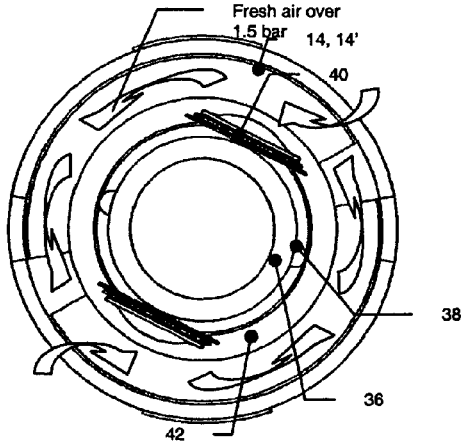
Figure 35A:
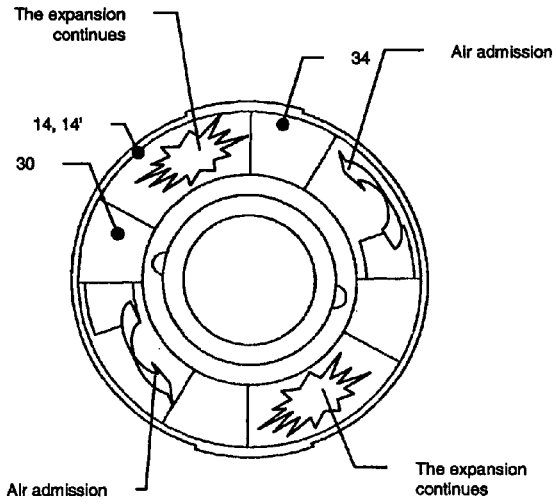
FIGS. 35A and 35B are front and rear schematic views respectively of a next sequential operating step from that shown in FIGS. 34A and 34B.
Figure 35B:
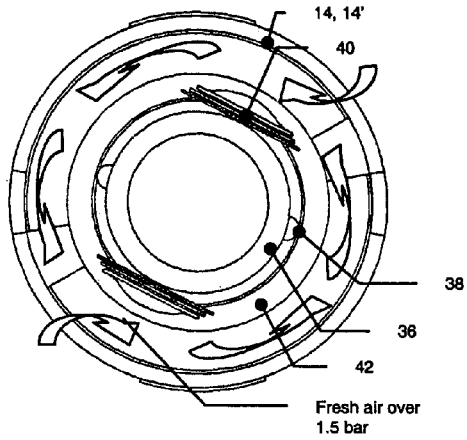
Figure 36A:
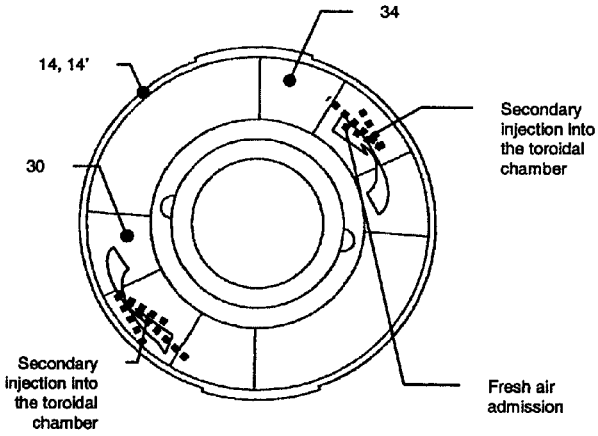
FIGS. 36A and 36B are front and rear schematic views respectively of a next sequential operating step from that shown in FIGS. 35A and 35B.
Figure 36B:
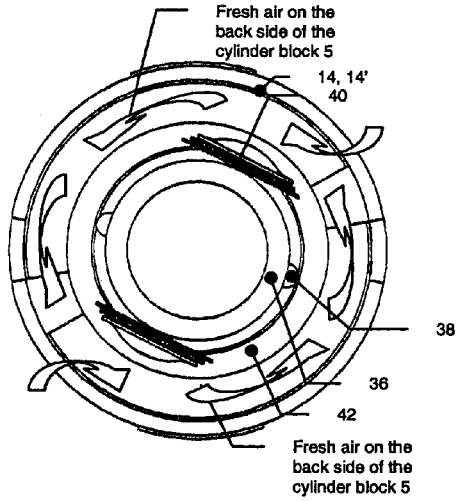

With reference to FIGS. 34A, through 35B, upon the compressed air/fuel mixture reaching a certain point of compression, the gas mixture is ignited as in FIG. 34A. Concurrently, the cooling process continues by the intake air flowing through corresponding portions of the toroidal path of travel "behind" the ignition of the primary air/fuel mixture and the cooperative positioning of the interactive piston assemblies 16 associated therewith.

One structural and operational feature, as generally indicated above, is the operation of the locking assembly 60 comprising the plurality of locking members 62 as schematically represented in FIG. 13. Immediately prior to and during the ignition of the primary air/fuel mixture, the second pistons 34 are disposed in a locked position along the toroidal path of travel due to activation of the plurality of locking members into the aforementioned locked orientation. This serves to fix the pair of second pistons 34 in a predetermined position concurrently to the beginning and continuance of the ignition phase. Accordingly, the majority of the energy developed from the ignition and thermal expansion of the ignited gases causes a forced rotation or travel of the pair of first pistons 30 and the resulting forced rotation of the power take-off 18 as demonstrated in FIGS. 35A and 35B. A significant portion of the resulting thermal energy is thereby converted to mechanical energy to accomplish the forced rotation of the pair of first pistons 30 and the driving rotation of the power take-off 18 connected thereto.

Figure 37A:
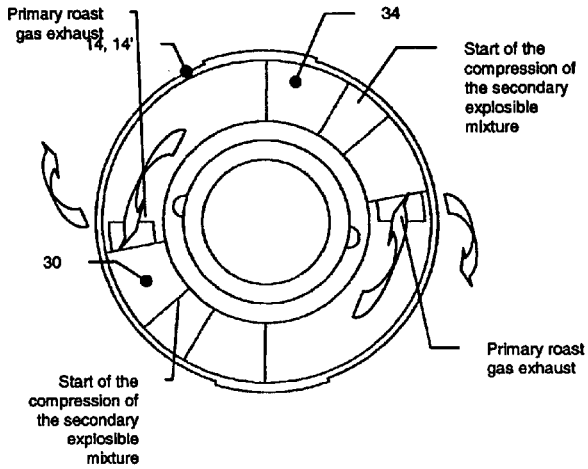
FIGS. 37A and 37B are front and rear schematic views respectively of a next sequential operating step from that shown in FIGS. 36A and 36B.
Figure 37B:
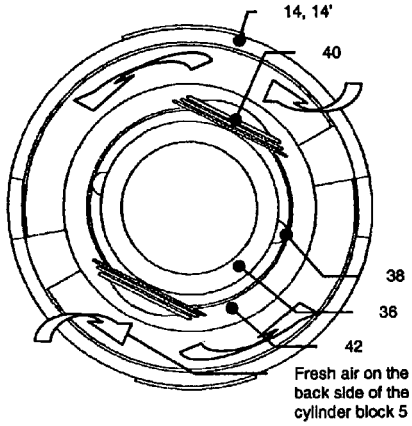
Figure 38A:
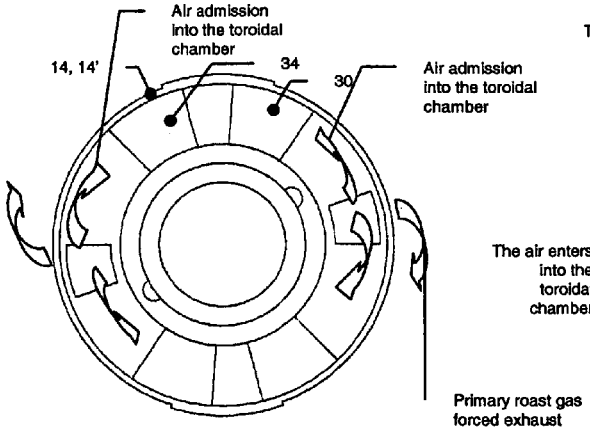
FIGS. 38A and 38B are front and rear schematic views respectively of a next sequential operating step from that shown in FIGS. 37A and 37B.
Figure 38B:
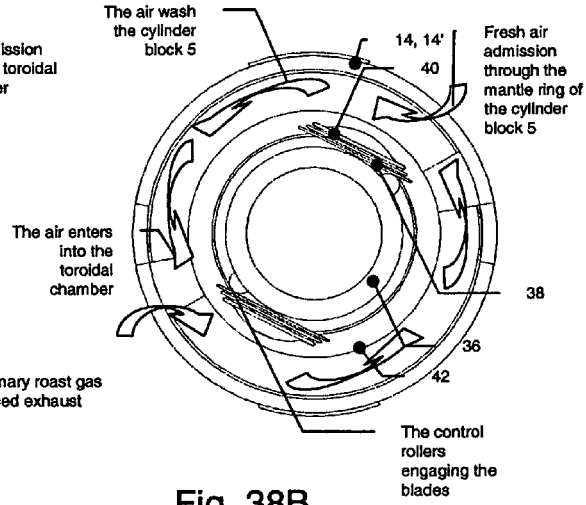

As demonstrated in FIGS. 37A through 37B, the evacuation of the exhaust gases begins after the power stroke develops from the ignition of the air/fuel mixture and the burned gas mixture begins to evacuate through the evacuation windows 50, 50'. At this time, the pair of first pistons 30 has traveled a length of approximately four times the diameter of the piston (as compared with the regular four stroke engines via travel length in the ratio of 1/1).

Subsequent to the evacuation of the exhaust gases, the admission windows 48, 48' are open due to the passage of the pair of first pistons 30 beyond the admission windows 48, 48'. As a result, cooling air is admitted through the admission windows 48, 48' from the respective inlet flow paths 47 associated with the intake segment 24 as described in detail above. As a result, the chamber 14 is cooled along at least a portion of the toroidal path of travel existing between the front end of the pair of second pistons 34 and the rear end of the pair of first pistons 30 and the intake and exhaust chambers. The plurality of engine cycles continues in an uninterrupted fashion as the interactive piston assembly 16 continues to rotate by cooperative structuring and disposition of the pair of first pistons 30 and the pair of second pistons 34.

Additional structural features providing versatility to the rotary I.C. engine 1 of the present invention is accomplished by the blocking assembly or biasing structure 40, which may be in the form of blade springs, being capable of rotational adjustment by approximately 60 degrees clockwise thereby regulating the location of the primary ignition and by allowing it to occur at the proper time in each engine cycle. As set forth above, for a full angular coverage throughout the toroidal path of travel (360 degrees) there are four primary ignitions and four resulting power strokes. The combination and concurrent operation of two operating chambers, each including an interactive piston assembly 16 and 16' results in eight power strokes as indicated above.

Other operative features and performance characteristics of a most preferred embodiment of the rotary I.C. engine 1 of the present invention include regulation of the pressure before the ignition of the primary air fuel mixture generally between 10 and 40 bar or twice the diesel engine range depending on the type of fuel utilized. This results in a more complete burning of the primary air/fuel mixture. In addition, the pressure in the high range indicated also determines that self ignition of the air/fuel mixtures is possible without the provision or operation of any type of ignition device, such as a spark plug, glow plug, etc. However, at least one preferred embodiment of the present invention may include the use of an appropriate ignition device such as, but not limited to, a spark plug or the like. Also, as represented in FIGS. 1 and 2, one or more appropriate type ignition structures 37 are functional and cooperatively associated with the spark plugs of each operating chamber 14 and 14' to cause the activation and/or powering thereof on a timely basis.

As set forth above, the pressure within the operating chambers 14 and 14', during the ignition phase of each power stroke, can be varied between 10 and 40 bar, depending on the type of fuel. The high end of such a pressure range is generally twice the pressure range of conventional diesel engines and not only results in a more complete burning of the air fuel or explosive mixture but may be sufficient to accomplish "self ignition" of the explosive fuel mixture. However, in other instances a spark plug or other ignition device, such as the type set forth above, may be utilized and appropriately mounted and/or connected so as to ignite the explosive fuel mixture once delivered into the interior of the operating chambers 14 and 14'. By way of example only, the ignition device may be mounted directly on one or both of the first or second pistons 30 and 34 of the interactive piston assembly 16, as described above. By way of example and regardless of its specific structure, an ignition device may be mounted both on or adjacent to the front or leading portion as well as on or adjacent to the rear or trailing portion of the first pistons 30 so as to facilitate the secondary and primary ignitions.

As described above with particular reference to the sequential operating steps as disclosed in FIGS. 25A, 25B through 37A, 37B, the explosive fuel mixture is injected at predetermined appropriate times into the interior of each of the operating chambers 14 and 14' so as to accomplish the primary and secondary ignitions. Accordingly, the explosive fuel mixture delivery assembly generally indicated as 90 in FIGS. 39 and 40 may comprise operative components which are activated to accomplish the injection of the explosive mixture into the interior of the operating chambers 14 and 14' by cooperative structuring and placement relative to and in association with the blocking assembly or biasing structure 40 associated with each of the operating chambers 14 and 14'. More specifically, FIG. 39 discloses what may be appropriately referred to as an injection assembly, generally indicated as 92. The injection assembly 92 includes a piston base 94 having one end or other portion generally indicated as 96 connected to the blocking assembly or biasing structure 40. As such, movement or flexure of the biasing structure 40, due to interaction with the restricting members 38, will cause linear, reciprocal movement as schematically indicted by directional arrow 95. The injection assembly 92 further includes a piston head generally indicated as 98 which is threadedly or otherwise secured to the piston base 94, such as at the opposite end, generally indicated as 99. Accordingly, once the piston head 98 is mounted on the piston base 94, the piston head 98 moves with the piston base 94 in the aforementioned linear, reciprocal direction 95 at a predetermined timed sequence dictated by interaction between the restraining members 38 and the blocking assembly or biasing members 40. For purposes of clarity, interior and exterior threads 100 and 100' are formed on appropriate portions of the piston head 98 and end portion 99 of the piston base 94 for interconnection of the piston head 98 to the piston base 94. Other structural features associated with the piston head 98 include annular or other configured grooves or recesses 102 formed in the piston head 98 for the mounting of seal rings or other seal structures thereon. Accordingly, reciprocal movement 95 of the piston head 98, within interior of the injection cylinder assembly 104, will efficiently accomplish injection of the explosive fuel mixture into the interior of corresponding ones of the operating chambers 14 and 14' as described in detail with regard to FIGS. 25A, 25B through 37A, 37B.

Figure 40:
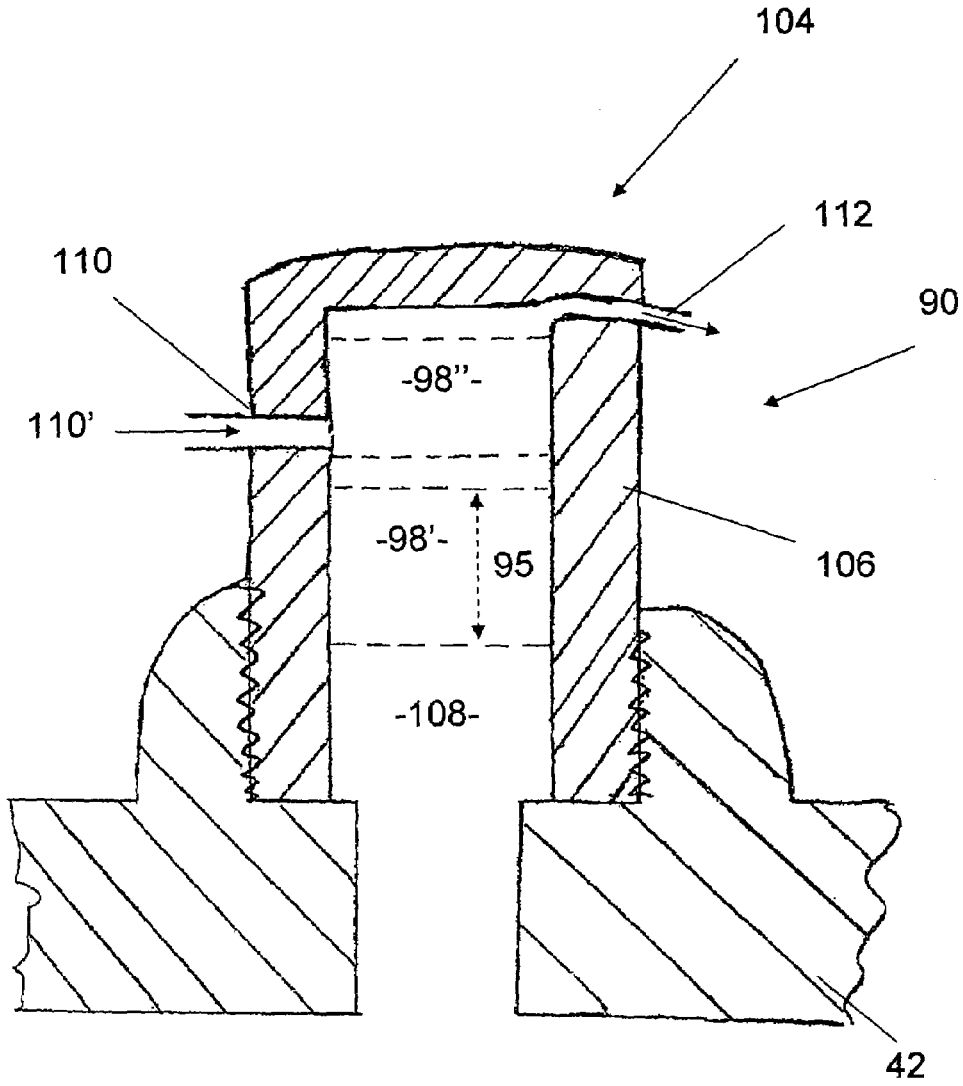
FIG. 40 is a sectional view in partial cutaway of another operative component of the fuel delivery assembly structured to cooperatively operate with the component disclosed in FIG. 38 for delivery of fuel to the operating chambers.

With primary reference to FIG. 40, the injection cylinder assembly 104 includes a cylinder housing 106 having chamber 108 formed on the interior thereof. The piston head 98 moves reciprocally, as at 95, within the chamber 108. Further, an inlet port 110 and an outlet port 112 establish fluid communication for flow of the explosive mixture into and out of the chamber 108. More specifically, the inlet port 110 is connected to a fuel supply (not shown for purposes of clarity) from which fuel or more specifically an air fuel or explosive mixture is delivered into the interior of the chamber 108. The outlet port 112 establishes fluid communication between the chamber 108 and the toroidal path of travel within a corresponding one of the operating chambers 14 and 14'. It should be apparent that each of the operating chambers 14 and 14' are associated with a different at least one fuel delivery assembly 90 which includes both the injection assembly 92 and the chamber assembly 104.

For purposes of clarity, the piston head 98 is schematically represented in FIG. 40 in phantom lines and is indicated in its various operative positions as 98' and 98". As set forth above, the reciprocal movement 95 of the injection assembly 92 will force the piston head 98 to reciprocate within the chamber 108 in a manner which will draw the explosive fuel mixture into the interior of the chamber 108 through inlet port 110 and subsequently force the contained explosive mixture outwardly, through outlet port 112, into the interior of a corresponding operating chamber 14 and 14'. In operation, the downward travel of the piston head 98 within the chamber 108 into the position 98' will cause a vacuum or negative pressure to be created in the upper, unoccupied part of the chamber 108. This negative pressure will force the inflow of the explosive fuel mixture, as at 110' through the inlet port 110 into the upper, unoccupied portion of the chamber 108. An upward change in the direction of the travel of the piston head 98 will accomplish a sealing of the inlet port 110 and a forced travel of the explosive mixture out of the chamber 108, through the outlet port 112. The expelled fuel or explosive mixture will thereby be injected into the interior of the corresponding operating chamber 14 or 14'. Predetermined quantities of the explosive mixture which are adequate for both the primary and secondary ignitions are thereby injected at the appropriate times, based on the interaction of the restricting members 38 with the blocking assembly or biasing structures 40, as schematically demonstrated by the substantially sequential operating steps of FIGS. 25A, 25B through 37A, 37B.

Finally, it should be further noted that the fuel delivery assembly 90 is representative of one of a possible plurality of different structural embodiments that could be used to timely inject the explosive fuel mixture into the toroidal path of travel of each of the operating chambers 14 and 14'. The present invention further contemplates the use of other types of fuel or explosive mixture delivery or injection systems.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A rotary internal combustion engine comprising:

a) at least one chamber having an interior comprising a toroidal path of travel, b) a housing disposed in outwardly spaced, at least partially surrounding relation to said chamber, c) an intake assembly and an exhaust assembly each structured to define fluid communication between said interior and an exterior of said chamber, d) an interacting piston assembly comprising at least a first piston and a second piston each movable within said interior along said toroidal path of travel, e) said first piston connected in driving relation to a power take-off and said second piston positionable in driving relation to said first piston, f) said first and second pistons cooperatively structured and relatively disposed to accomplish intake, compression, ignition and exhaust phases of an engine cycle during forced travel of said first piston along said toroidal path of travel, g) a restricting assembly disposed in interconnecting relation between said second piston and said chamber and structured to at least partially restrict movement of said second piston at a predetermined location along said toroidal path of travel, and h) said restricting assembly comprising at least one restricting member interconnected to said second piston and movable therewith, said restricting assembly further comprising a blocking assembly disposed in interruptive relation to, said restricting member as said second piston moves along said toroidal path of travel.

2. A rotary internal combustion engine as recited in claim 1 wherein said blocking assembly comprises a biasing structure disposed and structured to bias said second piston into a restricted movement along said toroidal path of travel until a predetermined force is exerted on said second piston at least partially by said first piston.

3. A rotary internal combustion engine comprising:

a) at least one chamber having an interior which includes a toroidal path of travel, b) a housing disposed in outwardly spaced, at least partially surrounding relation to said cylinder, c) an intake assembly and an exhaust assembly each structured to define fluid communication between said toroidal path of travel and an exterior of said chamber, d) an interactive piston assembly comprising a pair of first pistons disposed in substantially opposed relation to one another and concurrently movable along said toroidal path of travel, e) said interactive piston assembly comprising a pair of second pistons disposed in substantially opposed relation to one another and concurrently movable along said path of travel, f) said pair of first pistons connected in driving relation to a power take-off and said pair of second pistons positionable in driving relation to said pair of first pistons, g) said first and second pistons cooperatively structured and relatively disposed to accomplish intake, compression, ignition and exhaust phases of an engine cycle during forced travel of said pair of first pistons along said toroidal path of travel, h) a restricting assembly disposed in interconnecting relation between each of said second pistons and said chamber and structured to at least partially restrict movement of said second pistons at a predetermined location along said toroidal path of travel, and i) said restricting assembly comprising at least one restricting member interconnected to each of said second pistons and movable therewith, said restricting assembly further comprising a blocking assembly disposed in interruptive relation to said restricting member of each said second pistons as said second pistons move along said toroidal path of travel.

4. A rotary internal combustion engine as recited in claim 3 wherein said blocking assembly comprises a plurality of biasing structures disposed and structured to bias said second pistons into a restricted movement along said toroidal path of travel until a predetermined force is exerted thereon at least, partially by corresponding ones of said first pistons.

5. A rotary internal combustion engine comprising:

a) at least one chamber having an interior comprising a toroidal path of travel, b) a housing disposed in outwardly spaced, at least partially surrounding relation to said chamber, c) an intake assembly and an exhaust assembly each structured to define fluid communication between said interior and an exterior of said chamber, d) an interacting piston assembly comprising at least a first piston and a second piston each movable within said interior along said toroidal path of travel, e) said first piston connected in driving relation to a power takeoff and said second piston positionable in driving relation to said first piston, f) said first and second pistons cooperatively structured and relatively disposed to accomplish intake, compression, ignition and exhaust phases of an engine cycle during forced travel of said first piston along said toroidal path of travel, g) a restricting assembly disposed in interconnecting relation between said second piston and said chamber and structured to at least partially restrict movement of said second piston at a predetermined location along said toroidal path of travel, h) a locking assembly at least partially mounted on said second piston said locking assembly positionable in a locked orientation to dispose said second piston in a predetermined locked position along said toroidal path of travel, and i) said predetermined locked position of said second piston occurring substantially concurrently to said ignition phase and further defining said second piston disposed in substantially driving relation to said first piston.

6. A rotary internal combustion engine as recited in claim 5 wherein said intake assembly and said exhaust assembly respectively comprise an intake segment and an exhaust segment cooperatively structured and disposed to at least partially define said toroidal path of travel on said interior of said chamber.

7. A rotary internal combustion engine as recited in claim 6 further comprising said housing cooperatively disposed and structured with said intake and exhaust segments to define separate flow paths for intake fluid and exhaust fluid being at least partially disposed exteriorly of said chamber.

8. A rotary internal combustion engine as recited in claim 7 wherein said intake segment comprises at least one inlet and at least one admission window disposed in spaced relation to one another and defining an intake flow path there between, said one inlet disposed in communicating relation between an exterior of said chamber and said intake flow path, said admission window disposed in communicating relation between said intake flow path and said toroidal path of travel.

9. A rotary internal combustion engine as recited in claim 8 wherein intake fluid passing along said intake flow path defines a cooling medium of said cylinder.

10. A rotary internal combustion engine as recited in claim 7 comprising a plurality of inlets and a plurality of admission windows formed in said intake segment, each of said plurality of inlets operatively associated with a downstream, spaced apart one of said plurality of admission windows so as to at least partially define an intake flow path there between.

11. A rotary internal combustion engine as recited in claim 10 wherein each of said inlets is disposed in communicating relation between an exterior of said chamber and a corresponding intake flow path, each of said admission windows disposed in fluid communicating relation between a corresponding intake flow path and said toroidal path of travel.

12. A rotary internal combustion engine as recited in claim 11 wherein intake fluid passing along said intake flow paths defines a cooling medium of said chamber.

13. A rotary internal combustion engine as recited in claim 7 wherein said exhaust segment comprises at least one evacuation window and at least one outlet disposed in predetermined spaced relation to one another and defining an exhaust flow path there between, said evacuation window disposed in communicating relation between said toroidal path of travel and said exhaust flow path; said outlet disposed in communicating relation between said exhaust flow path and an exterior of said chamber.

14. A rotary internal combustion engine as recited in claim 7 further comprising a plurality of evacuation windows and a plurality of outlets formed in said exhaust segment, each of said evacuation windows operatively associated with a downstream, spaced apart one of said plurality of outlets so as to at least partially define an exhaust flow path extending there between and at least partially along and exteriorly of said chamber.

15. A rotary internal combustion engine as recited in claim 14 wherein each of said evacuation windows is disposed in fluid communication between said toroidal path of travel and a corresponding exhaust flow path; each of said outlets disposed in fluid communication between a corresponding exhaust flow path and an exterior of said chamber.

16. A rotary internal combustion engine as recited in claim 5 wherein said locking assembly comprises a plurality of locking members disposable outwardly from a periphery of said second piston into removably locked engagement with a portion of said chamber when said locking assembly is in said locked orientation.

17. A rotary internal combustion engine as recited in claim 16 wherein said locking assembly is disposed out of said locked orientation during said evacuation phase, whereby said second piston is movable along said toroidal path of travel.

18. A rotary internal combustion engine as recited in claim 5 wherein said predetermined location of restricted movement corresponds to a beginning of said compression phase of an air/fuel mixture disposed within said toroidal path of travel.

19. A rotary internal combustion engine as recited in claim 5 wherein exterior surfaces of said first and second pistons move along said toroidal path of travel in an inwardly spaced, non-contacting relation to corresponding interior surfaces of said cylinder.

20. A rotary internal combustion engine comprising:

a) at least one chamber having an interior which includes a toroidal path of travel, b) a housing disposed in outwardly spaced, at least partially surrounding relation to said cylinder, c) an intake assembly and an exhaust assembly each structured to define fluid communication between said toroidal path of travel and an exterior of said chamber, d) an interactive piston assembly comprising a pair of first pistons disposed in substantially opposed relation to one another and concurrently movable along said toroidal path of travel, e) said interactive piston assembly comprising a pair of second pistons disposed in substantially opposed relation to one another and concurrently movable along said path of travel, f) said pair of first pistons connected in driving relation to a power take-off and said pair of second pistons positionable in driving relation to said pair of first pistons, g) said first and second pistons cooperatively structured and relatively disposed to accomplish intake, compression, ignition and exhaust phases of an engine cycle during forced travel of said pair of first pistons along said toroidal path of travel, h) a restricting assembly disposed in interconnecting relation between each of said second pistons and said chamber and structured to at least partially restrict movement of said second pistons at a predetermined location along said toroidal path of travel, i) a locking assembly at least partially mounted on each of said pistons, said locking assembly removably disposable in a locked orientation along a predetermined portion of said path of travel, and j) said locking assembly comprising a plurality of locking members disposed outwardly from a periphery of each of said second pistons and into removable, locked engagement with a portion of said chamber when said locking assembly is in said locked orientation.

21. A rotary internal combustion engine as recited in claim 20 wherein exterior surfaces of said first and second pistons move along said toroidal path of travel in an inwardly spaced, non-contacting relation to corresponding interior surfaces of said cylinder.

22. A rotary internal combustion engine as recited in claim 20 wherein said intake assembly and said exhaust assembly respectively comprise an intake segment and an exhaust segment cooperatively structured and disposed to at least partially define said toroidal path of travel of said interior of said chamber.

23. A rotary internal combustion engine as recited in claim 22 further comprising said housing cooperatively disposed and structured with said intake and exhaust segments to define separate flow paths for intake fluid and exhaust fluid being at least partially exposed exteriorly of said chamber.

24. A rotary internal combustion engine as recited in claim 22 further comprising a plurality of inlets and a plurality of admission windows formed in said intake segment, each of said inlets operatively associated with a downstream, spaced apart one of said admission windows to at least partially define an intake flow path at least partially extending there between and along and exteriorly of said toroidal path of travel.

25. A rotary internal combustion engine as recited in claim 24 wherein each of said inlets is disposed in fluid communication between an exterior of said chamber and a corresponding intake flow path; each of said admission windows disposed in fluid communication between a corresponding intake flow path and an exterior of said chamber.

26. A rotary internal combustion engine as recited in claim 24 further comprising a plurality of evacuation windows and a plurality of outlets formed in said exhaust segment, each of said evacuation windows operatively associated with a downstream, spaced apart one of said outlets to at least partially define an exhaust flow path at least partially extending there between and along and exteriorly of said cylinder.

27. A rotary internal combustion engine as recited in claim 26 wherein each of said evacuation windows is disposed in fluid communication between said toroidal path of travel and a corresponding exhaust flow path and each of said outlets in disposed in fluid communication between a corresponding exhaust flow path and an exterior of said cylinder.

28. A rotary internal combustion engine as recited in claim 24 wherein intake fluid passing along said intake flow path defines a cooling medium for said cylinder.

29. A rotary internal combustion engine as recited in claim 20 wherein said locking assembly is structured to fixedly and removably secure said second pistons within said predetermined portion of said toroidal path of travel.

30. A rotary internal combustion engine as recited in claim 20 wherein said locking assembly is disposed in said locked orientation substantially concurrent to said ignition phase of said engine cycle.

31. A rotary internal combustion engine as recited in claim 20 wherein said locking assembly is disposed out of said locked orientation during said exhaust phase, whereby each of said second pistons are movable along said toroidal path of travel.

32. A rotary internal combustion engine as recited in claim 20 wherein said predetermined location of restricted movement substantially corresponds to a beginning of said compression phase of an air/fuel mixture disposed within said toroidal path of travel.

* * * * *